US012768250B2

(12) United States Patent
Busaidy et al.

(10) Patent No.: US 12,768,250 B2
(45) Date of Patent: Oct. 20, 2026

(54) IMPLOSION DEVICE

(71) Applicant: Schlumberger Technology Corporation, Sugar Land, TX (US)

(72) Inventors: Adil Al Busaidy, Ilfov (RO); Carlos Baumann, Rosharon, TX (US); Christopher Babin, Waveland, MS (US); Fokko Doornbosch, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/836,575

(22) PCT Filed: Apr. 25, 2023

(86) PCT No.: PCT/US2023/019708

§ 371 (c)(1),
(2) Date: Aug. 7, 2024

(87) PCT Pub. No.: WO2023/211870

PCT Pub. Date: Nov. 2, 2023

(65) Prior Publication Data

US 2025/0163778 A1 May 22, 2025

Related U.S. Application Data

(60) Provisional application No. 63/363,603, filed on Apr. 26, 2022.

(51) Int. Cl.

| | |
|---|---|
| ***E21B 37/08*** | (2006.01) |
| ***E21B 27/00*** | (2006.01) |
| ***E21B 49/08*** | (2006.01) |

(52) U.S. Cl.
CPC ..... *E21B 37/08* (2013.01); *E21B 27/00* (2013.01); *E21B 49/081* (2013.01)

(58) Field of Classification Search
CPC ..... E21B 37/08; E21B 27/00; E21B 49/081
See application file for complete search history.

(56) References Cited

U.S. PATENT DOCUMENTS 2,361,558 A * 10/1944 Mason ..... E21B 37/08 166/299
3,273,642 A * 9/1966 Karpovich ..... E21B 43/263 166/308.1

(Continued)

FOREIGN PATENT DOCUMENTS

WO 2013073948 A1 5/2013
WO 2015152907 A1 10/2015

OTHER PUBLICATIONS

Search Report and Written Opinion of International Application No. PCT/US2023/019708 dated Aug. 11, 2023, 13 pages.

*Primary Examiner* — Neel Girish Patel
(74) *Attorney, Agent, or Firm* — Jeffrey D. Frantz

(57) ABSTRACT

Described herein are implosion devices for use in a subterranean setting. These implosion devices use no explosives, and so create no combustion products within the subterranean environment. These implosion devices also capture all material used to create the implosion for easy removal from the subterranean environment. The implosion devices generally have an implosion chamber, a stretchable sleeve surrounding the implosion chamber, and a non-explosive initiator for imploding the implosion chamber.

8 Claims, 17 Drawing Sheets

(56) References Cited

U.S. PATENT DOCUMENTS

| | | | | |
|---|---|---|---|---|
| 3,648,769 | A * | 3/1972 | Sawyer | B08B 3/12 166/177.2 |
| 3,712,378 | A * | 1/1973 | Olivier | E21B 37/08 166/299 |
| 4,805,726 | A * | 2/1989 | Taylor | G01V 1/133 367/146 |
| 5,836,393 | A * | 11/1998 | Johnson | E21B 37/08 166/308.1 |
| 8,726,996 | B2 | 5/2014 | Busaidy et al. | |
| 2003/0106688 | A1* | 6/2003 | Saugier | E21B 7/208 175/320 |
| 2004/0231840 | A1 | 11/2004 | Ratanasirigulchai et al. | |
| 2008/0236935 | A1* | 10/2008 | Coates | E21B 47/06 181/103 |
| 2010/0155054 | A1 | 6/2010 | Innes et al. | |
| 2010/0300690 | A1* | 12/2010 | Al Busaidy | E21B 37/08 166/69 |
| 2011/0011587 | A1* | 1/2011 | Al Busaidy | E21B 43/117 166/55.1 |
| 2013/0220613 | A1* | 8/2013 | Brooks | E21B 43/1185 175/3.5 |
| 2015/0337629 | A1* | 11/2015 | Zhang | E21B 43/25 166/250.01 |
| 2016/0265312 | A1* | 9/2016 | Holly | E21B 33/12 |
| 2020/0103540 | A1* | 4/2020 | Gorbunov | G01V 1/42 |

* cited by examiner

IMPLOSION DEVICE

CROSS-REFERENCE TO RELATED APPLICATION

This application is a national stage entry under 35 U.S.C. § 371 of International Application No. PCT/US2023/019708, filed Apr. 25, 2023, which claims priority to and benefit of U.S. Provisional Patent Application No. 63/363,603, entitled "Implosion Device", filed Apr. 26, 2022, which is incorporated herein by reference.

FIELD

This patent application relates to hardware for stimulating hydrocarbon reservoirs. Specifically, this patent application describes hardware for use in perforating wells drilled into geologic formations.

BACKGROUND

This section provides background information to facilitate a better understanding of the various aspects of the disclosure. It should be understood that the statements in this section of this document are to be read in this light, and not as admissions of prior art.

Hydrocarbon reservoirs are commonly stimulated to increase recovery of hydrocarbons. Hydraulic fracturing, where a fluid is pressurized into the reservoir at a pressure above the fracture strength of the reservoir, is commonly practiced. In most fracturing practice, a well is drilled into the formation and a casing formed on the outer wall of the well. The casing is then perforated using explosives to form holes in the casing that can extend a short distance into the formation from the well wall. Perforation creates holes extending from the well wall into the formation. Material removed to form the holes can become debris that obstructs fluid flow within the holes from the formation into the well. That debris is commonly removed by creating a momentary pressure gradient that promotes fluid flow from the holes into the well to dislodge the debris from the holes.

Many conventional methods of removing debris from perforated wells uses explosive devices to create an underbalanced pressure in the well. Such methods can, unfortunately, create additional debris that reduces effectiveness. Such methods also create pollutants that remain in the well. There is a need for improved apparatus and methods for creating underbalanced pressure to clean out perforated formations.

SUMMARY

Certain embodiments commensurate in scope with the originally claimed disclosure are summarized below. These embodiments are not intended to limit the scope of the claimed disclosure, but rather these embodiments are intended only to provide a brief summary of possible forms of the disclosure. Indeed, embodiments may encompass a variety of forms that may be similar to or different from the embodiments set forth below.

Embodiments described herein provide a well-completion tool, comprising an implosion chamber; a stretchable sleeve surrounding the implosion chamber; and a non-explosive initiator for imploding the implosion chamber.

Other embodiments described herein provide an implosion device for subterranean use, comprising an implosion chamber having an interior pressure that is at or below atmospheric pressure; a stretchable sleeve surrounding the implosion chamber; and a non-explosive initiator for imploding the implosion chamber.

Other embodiments described herein provide a method of treating a subterranean formation, comprising disposing an implosion device in a well formed in the subterranean formation, the implosion device comprising an implosion chamber having an interior pressure that is at or below atmospheric pressure, a stretchable sleeve surrounding the implosion chamber, and a non-explosive initiator for imploding the implosion chamber; activating the initiator to implode the implosion chamber within the well; collecting debris of the implosion chamber in the sleeve; and removing the sleeve containing the debris from the well.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1A:
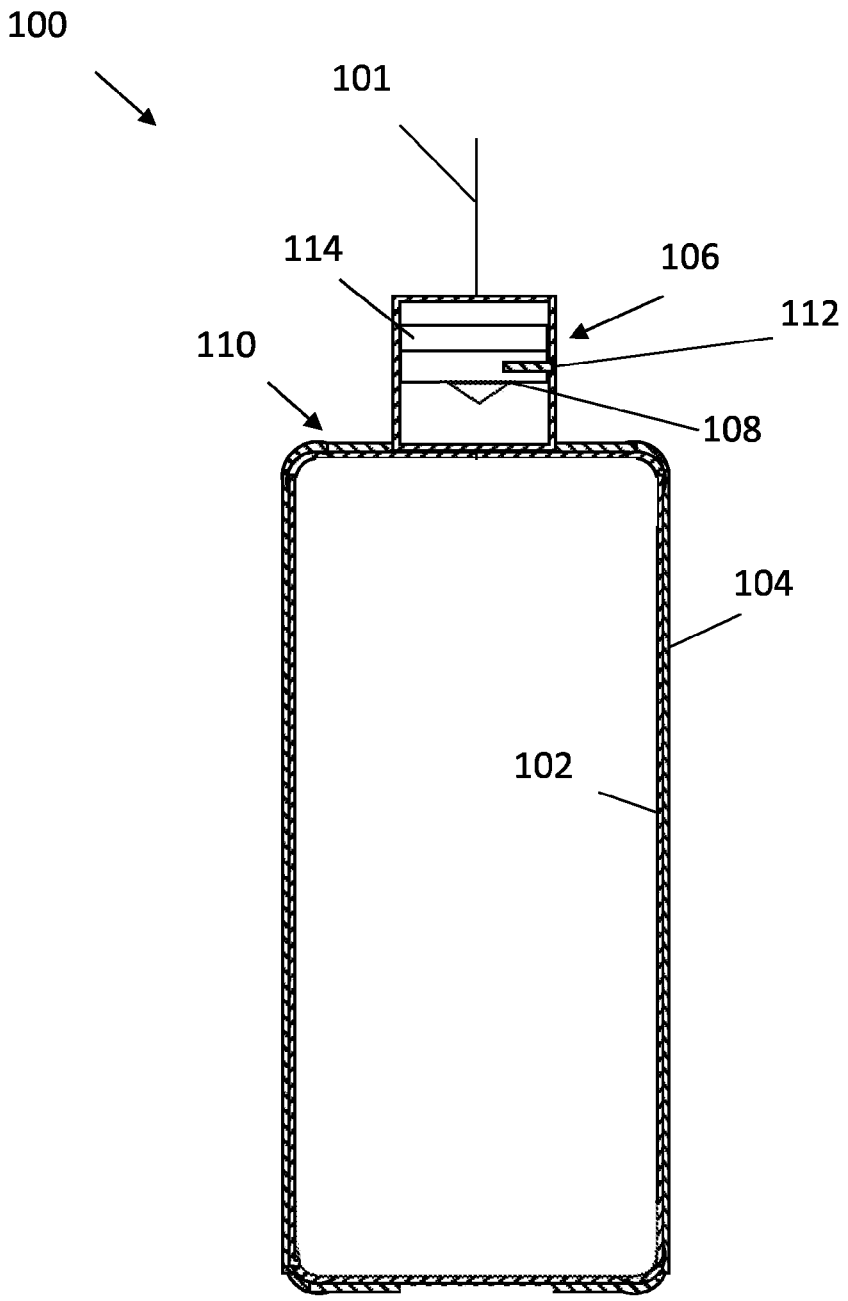
FIG. 1A is a schematic cross-sectional view of an implosion device, according to an embodiment of the disclosure.

In the following description, numerous details are set forth to provide an understanding of the present disclosure. However, it may be understood by those skilled in the art that the methods of the present disclosure may be practiced without these details and that numerous variations or modifications from the described embodiments may be possible.

At the outset, it should be noted that in the development of any such actual embodiment, numerous implementation-specific decisions are made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. The term about should be understood as any amount or range within 10% of the recited amount or range (for example, a range from about 1 to about 10 encompasses a range from 0.9 to 11). Also, in the summary and this detailed description, it should be understood that a concentration range listed or described as being useful, suitable, or the like, is intended that any concentration within the range, including the end points, is to be considered as having been stated. For example, "a range of from 1 to 10" is to be read as indicating each possible number along the continuum between about 1 and about 10. Furthermore, one or more of the data points in the present examples may be combined together, or may be combined with one of the data points in the specification to create a range, and thus include each possible value or number within this range. Thus, even if specific data points within the range, or even no data points within the range, are explicitly identified or refer to a few specific, it is to be understood that inventors appreciate and understand that any data points within the range are to be considered to have been specified, and that inventors possessed knowledge of the entire range and the points within the range.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

As used herein, "embodiments" refers to non-limiting examples disclosed herein, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program comprises instructions causing the computer to execute one or more of the operations, or to issue commands to other devices to execute one or more of the operations.

Described herein are implosion devices for use in a subterranean setting. These implosion devices use no explosives, and so create no combustion products within the subterranean environment. These implosion devices also capture all material used to create the implosion for easy removal from the subterranean environment, leaving essentially no trace the device was ever present in the subterranean environment.

FIG. 1A is a schematic cross-sectional view of an implosion device 100 according to one embodiment. The implosion device 100 comprises an implosion chamber 102, a sleeve 104, and an initiator 106. The implosion chamber 102 is a hollow chamber generally made of a breakable material like glass, ceramic, or terra cotta, but with strength enough to withstand transportation, handling, lowering into a well, and the like. The implosion chamber 102 can have any convenient shape, for example cylindrical, rectangular (box-shaped), spherical, spheroidal, or the like.

The sleeve 104 is made of a resilient sheet-like material, and is shaped to receive and stretch around the implosion chamber 102. When stretched around the implosion chamber 102, the sleeve 104 provides a slight compressive force that is approximately constant at all locations of contact between the sleeve 104 and the implosion chamber 102. The sleeve may be a rubber material, such as a silicone material, or a stretchy synthetic textile material, such as lycra.

The initiator 106 is a device that applies energy to break the implosion chamber. When deployed into a hydrocarbon well that has been perforated, the implosion device 100 is located at a desired depth within the well, generally adjacent to a perforated area in need of debris removal. At the desired depth, there is generally substantial fluid head pressure surrounding the implosion device 100 such that breaking the implosion chamber 102 rapidly generates an underpressure area with a large pressure gradient that causes fluids to rush inward toward the underpressure area. The rapid fluid flow results in rapid fluid outflow from well perforations, thus expelling at least a portion of the debris that can occupy such perforations and impede fluid flow from the formation into the well.

The initiator 106 can be, or can include, a device that makes physical contact with the implosion chamber 102, such as a hammer or piston, to break the implosion chamber 102. The initiator 106 can be, or can include, a device that directs energy onto the implosion chamber 102 or that causes energy to propagate to the implosion chamber 102 to break, or otherwise disrupt the material of, the implosion chamber 102 such that the chamber implodes rapidly to create the underpressure area.

The implosion device 100 is connected with a cable 101 for suspending the implosion device 100, lowering the implosion device 100 into a well, and removing the implosion device 100 (or the post-activation version of the implosion device 100) from the well. The implosion device 100 of FIG. 1A includes a hammer 108, which is a heavy object located adjacent to a top end 110 of the implosion chamber 102. Prior to activation, the heavy object is restrained at a location above the top end 110 by a restraint 112, which in this case is a shear pin. In other cases, the restraint 112 can be a disk or a suspension device such as a rod or wire. The restraint 112 is configured to break under appropriate stimulus to release the hammer 108. In the version of FIG. 1A, a jar 114 is disposed above the hammer 108 to allow quick motion of the implosion device 100 to create movement of the jar 114 to apply a downward impulse to break the restraint 112. For example, quick downward motion of the implosion device 100, or quick upward then downward motion, can cause the jar 114 to fall and impact the hammer 108, breaking the restraint 112. When the restraint 112 is broken, the hammer 108 can fall and impinge on the implosion chamber 102, breaking the material of the implosion chamber 102 and activating the implosion.

Figure 1B:
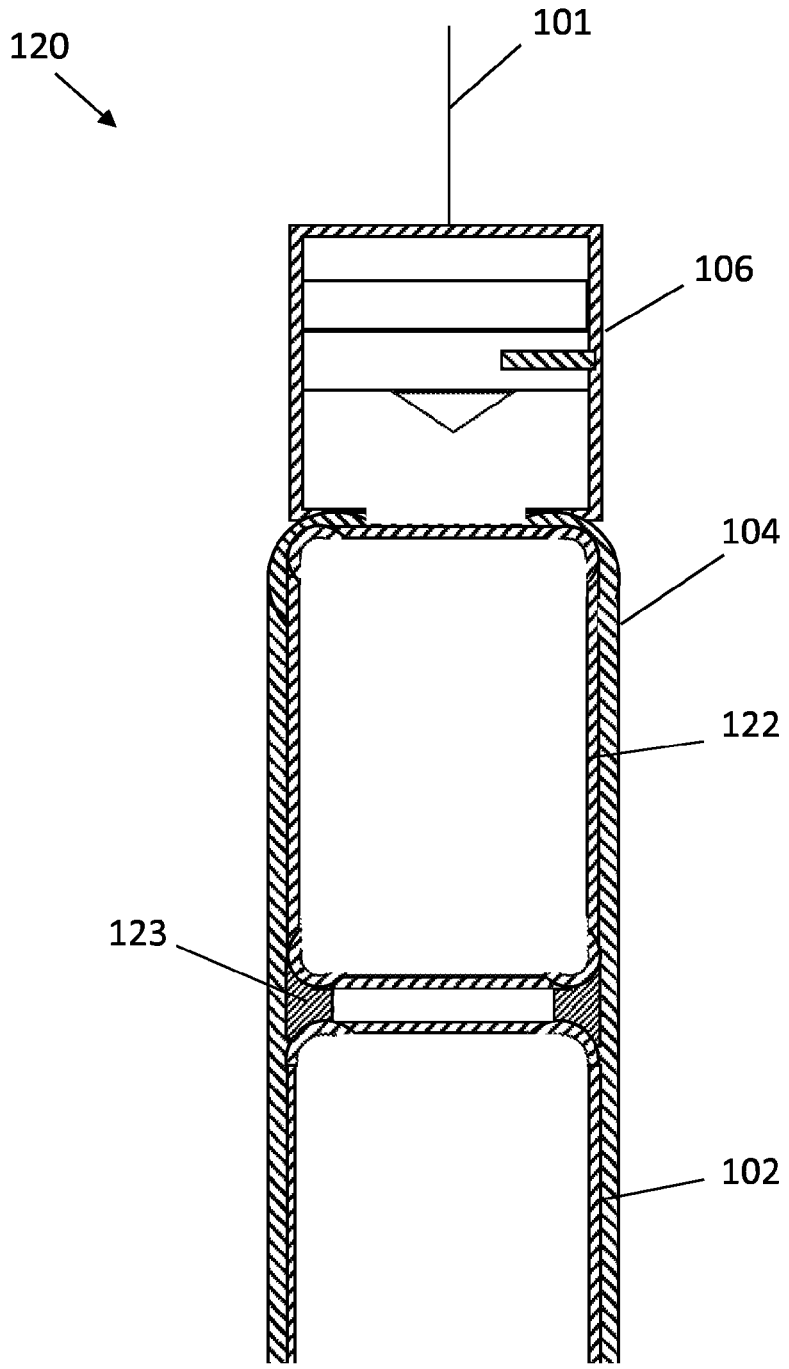
FIG. 1B is a detail view of a top section of an implosion device, according to an embodiment of the disclosure.

FIG. 1B is a detail view of a top section of an implosion device 120, according to another embodiment. In some cases, the material of the implosion chamber 102 may have such strength that the hammer 108 cannot fall fast enough through fluid within the well, or even within a fluid free channel, to acquire enough kinetic energy to break the material of the implosion chamber 102. In such cases, a trigger chamber 122 can be used to create a pressure shock in the well fluid near the implosion chamber 102. In such cases, the hammer 108 can be configured to fall onto the trigger chamber 122, breaking the trigger chamber 122 and causing implosion of the trigger chamber 122, which creates the pressure shock that breaks the material of the implosion chamber 102. If desired, a specific spacing can be maintained between the trigger chamber 122 and the implosion chamber 102 by using a spacer 123 disposed between the trigger chamber 122 and the implosion chamber 102 within the sleeve 104.

Figure 1C:
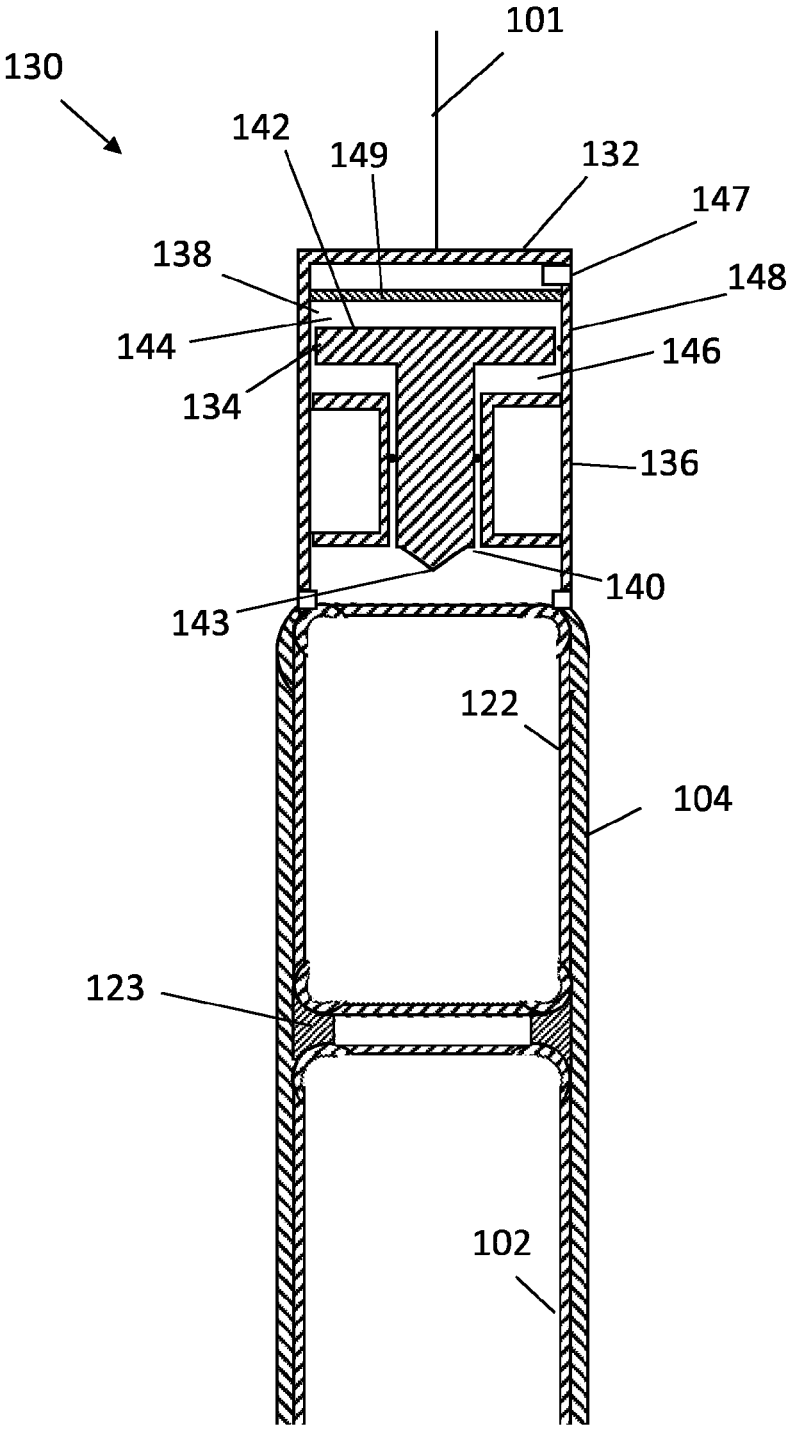
FIG. 1C is a detail view of a top section of an implosion device, according to an embodiment of the disclosure.

FIG. 1C is a detail view of a top section of an implosion device 130, according to another embodiment. In this case, a trigger chamber 122 is used with an electromechanical initiator 132. The electromechanical initiator 132 comprises a hydraulic puncture device 134 disposed in a canister 136 with a pressure chamber 138 and a channel 140. The electromechanical puncture device 134 is disposed within the canister 136 with the ability to move axially within the canister 136, a portion of the puncture device 134 moving within the channel 140 and a portion moving within the pressure chamber 138. The puncture device 134 has a pressure plate 142 that extends across the width of the pressure chamber 138 and seals against the inner wall of the pressure chamber 138, dividing the pressure chamber 138 into a first section 144 and a second section 146. The second section 146 fluidly communicates with the channel 140. The puncture device 134 is positioned such that movement of the puncture device 134 to its limit within the canister 136 brings a puncture end 143 of the puncture device 134, opposite from the pressure plate 142, to impinge upon the trigger chamber 122. When moved with enough force, the puncture end 143 of the puncture device 134 can break the material of the trigger chamber 122, creating the pressure shock to break the material of the implosion chamber 102. A valve 147 is disposed through a wall 148 of the first section 144 of the pressure chamber 138. The valve 147 has an electronic actuator (not shown) of any convenient type to operate the valve 147 upon receipt of an electronic signal. The electronic signal can be transmitted downhole along the cable 101 in the style of a wire line.

When the valve 147 receives an appropriate electronic signal along the cable 101, the valve 147 is configured to open, allowing ingress of well fluids at downhole pressure into the pressure chamber 138. A partition 149, such as a rupture disk, is disposed within the first section 144 of the pressure chamber 138 to prevent premature application of pressure to the pressure plate 142. The puncture device 134 and canister 136 are configured to operate under a selected pressure to break the trigger chamber 122. Pressure of well fluids ingressing into the pressure chamber 138 provides force to drive the puncture device 134 along the canister 136 to break the material of the trigger chamber 122. The partition can prevent leakage of fluids through the valve 147 prematurely activating the implosion device 130. The partition 149 may be a pressure rupture disk, such as a shear disk, that breaks when pressure within the first section 144 behind the partition 149 reaches a predetermined value. Upon rupture of the partition 149, pressurized fluids are freed to pressure the pressure plate 142 of the puncture device 134, moving the puncture device 134 to break the trigger chamber 122.

Figure 1D:
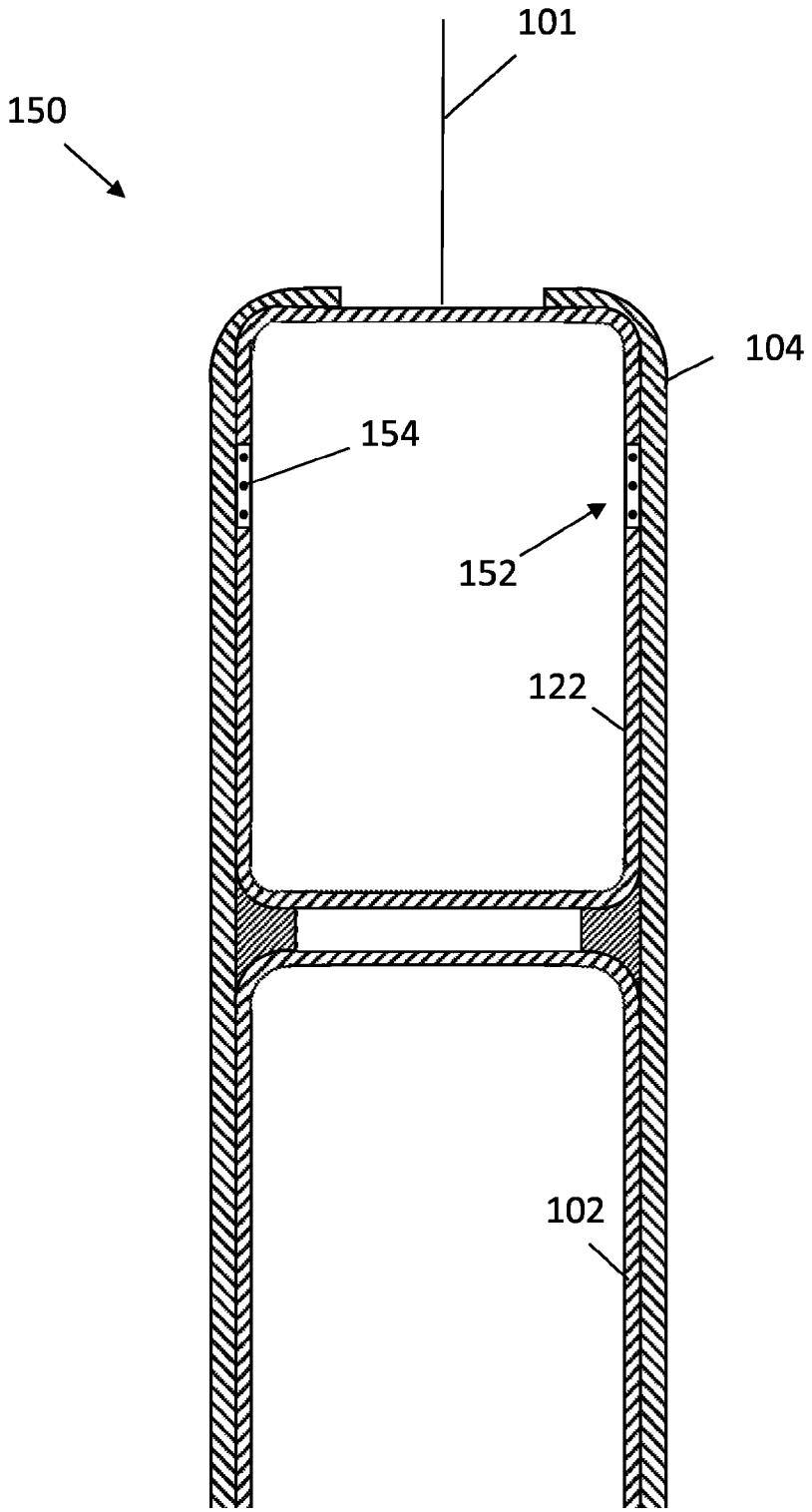
FIG. 1D is a detail view of a top section of an implosion device, according to an embodiment of the disclosure.

FIG. 1D is a detail view of a top section of an implosion device 150, according to another embodiment. This case uses a trigger chamber 122, although the trigger chamber 122 is optional, along with an energy device to create energy to initiate an implosion. In this case, the trigger chamber 122, or optionally the implosion chamber 102 itself, is made of a strong material that can be destabilized by heating. A thermal initiator 152 comprises a resistive heating element 154 disposed within an outer wall of the trigger chamber 122 or the implosion chamber 102, to heat the material of the chamber and destabilize or weaken the material. Power to the heating element 154 is provided either along the cable 101 from a surface power source, or from a downhole power source such as a battery or capacitor. Application of electric current to the heating element 154 causes heat to emanate into the material of the wall, raising the temperature of the wall and weakening the material either by softening or embrittlement. When sufficiently weakened, the material yields under pressure of well fluids and implodes. As before, the implosion chamber 102 can be directly imploded using heat destabilization, or the trigger chamber 122 can be imploded to create a pressure shock that implodes the implosion chamber 102.

Figure 1E:
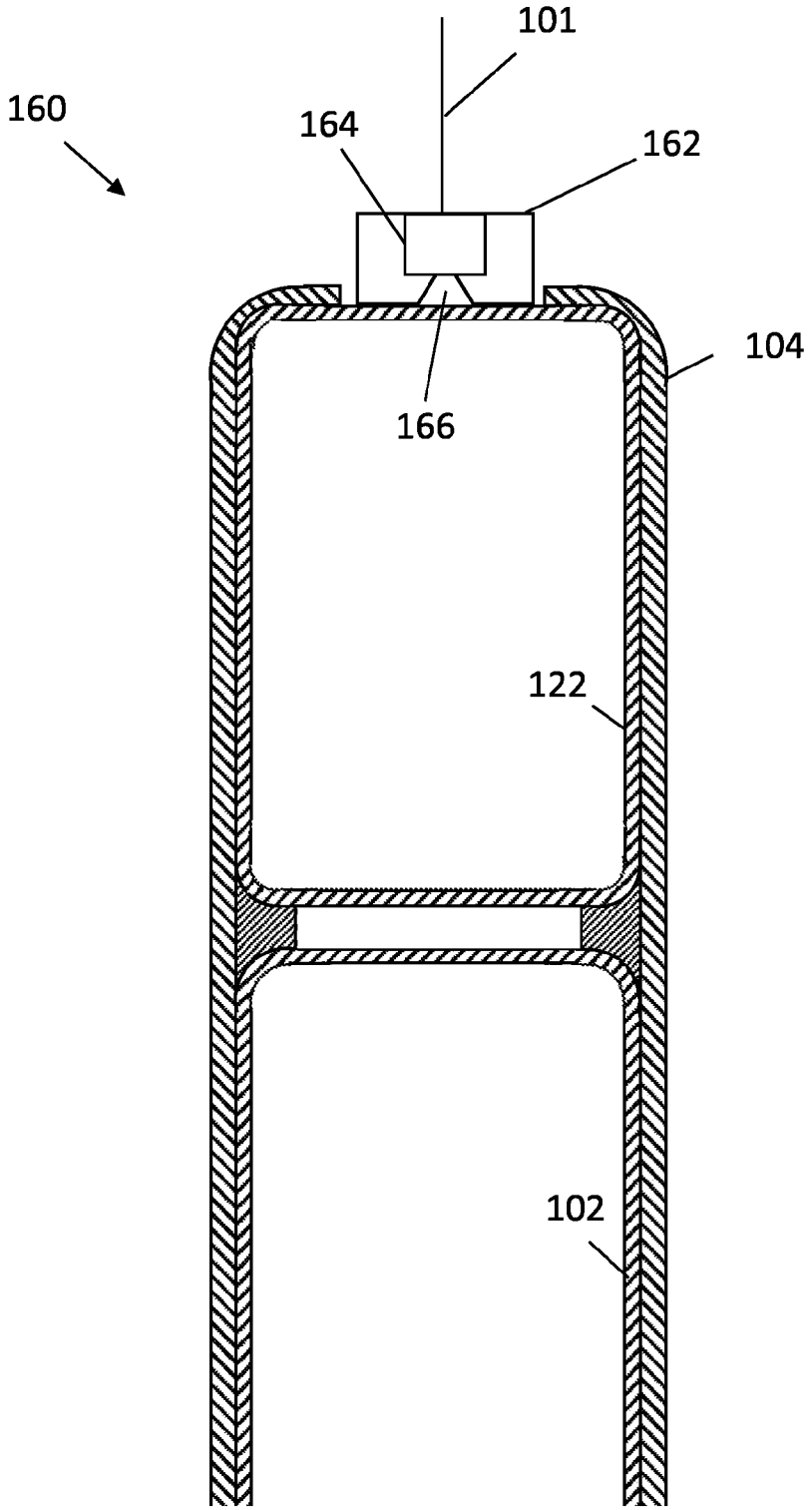
FIG. 1E is a detail view of a top section of an implosion device, according to an embodiment of the disclosure.

FIG. 1E is a detail view of a top section of an implosion device 160, according to another embodiment. The implosion device 160 has an acoustic initiator 162 disposed adjacent to the optional trigger chamber 122, the implosion chamber 102, or both, to provide acoustic energy selected to break the material of either chamber. Acoustic energy, as used herein, refers to a periodic pressure fluctuation that propagates through a medium. The acoustic initiator 162 is a device with an annunciator 164 that vibrates to initiate propagation of acoustic energy through well fluids surrounding the trigger chamber 122 or the implosion chamber 102. The acoustic initiator 162 may include a wave guide 166 to direct and/or focus the acoustic energy for increased effectiveness. Power for the annunciator 164 may be supplied from a surface or downhole power source. Frequency of the acoustic energy can be selected based on mechanical characteristics of the trigger chamber 122 or the implosion chamber 102, and the acoustic initiator 162 can include a frequency selector or a frequency modulator to increase effectiveness.

Figure 1F:
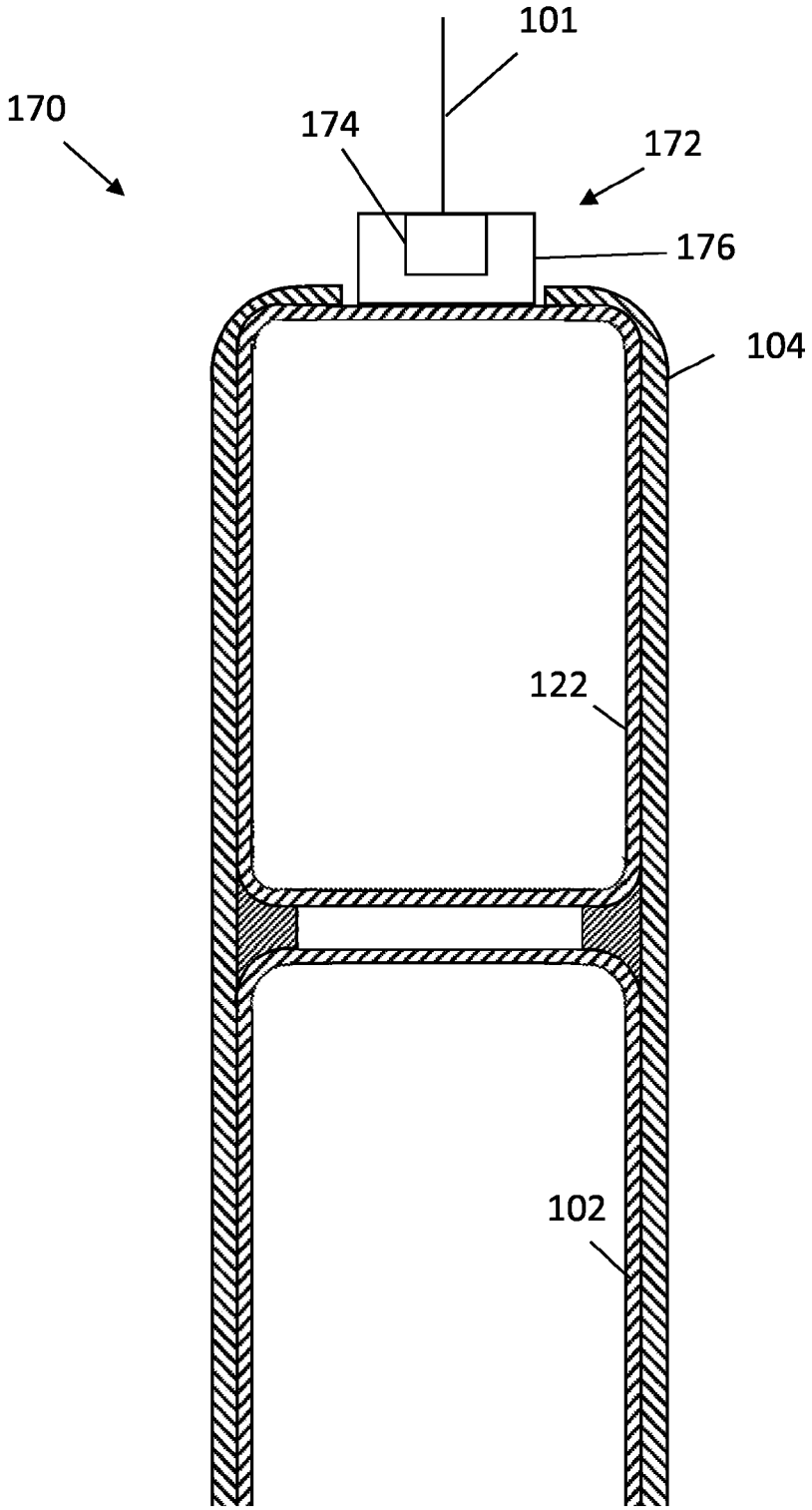
FIG. 1F is a detail view of a top section of an implosion device, according to an embodiment of the disclosure.

FIG. 1F is a detail view of a top section of an implosion device 170, according to another embodiment. In this case, the implosion device has an optical initiator 172 configured to propagate an intense electromagnetic radiation as optical energy toward the trigger chamber 122, which is optional, or the implosion chamber 102. The electromagnetic radiation is selected to propagate to the trigger chamber 122 or the implosion chamber 102, and is configured to interact with the material of the trigger chamber 122 or the implosion chamber 102 to cause either chamber to implode. In one case, the chamber material (either chamber) is selected to absorb energy from the incident radiation of the optical initiator 172 and to achieve a destabilization from absorbing the radiant energy. The optical initiator 172 is a device that includes an optical source 174, which can be a laser, LED, or bright light having high energy content, disposed in a propagation chamber 176 attached to the outer wall of either the trigger chamber 122 or the implosion chamber 102 and configured to propagate optical energy from the optical source 174 to the wall of the chamber. The wall of the chamber (the trigger chamber 122 or the implosion chamber 102) can be coated with, made from, or otherwise provided with a material selected to absorb the optical energy in a way that destabilizes the material of the chamber, causing it to break. The entire chamber can be made from that material, or that material may be provided only at a target illumination location to provide an energy absorption location on the wall of the chamber. In one case, the material is a black material that absorbs radiant energy from the optical source 174 and converts the absorbed energy to heat. Power for the optical source 174 may be provided by a surface or downhole power source.

Another way to trigger an implosion is using flash cooling. A cooling source, such as a compressed $CO_2$ or He canister can be located to provide a jet of expanding gas that impinges on the chamber to be broken (the trigger chamber or the implosion chamber). An initiator, similar to any of the mechanical or electromechanical initiators described herein, can be operated to pierce the canister to provide the jet of gas. The jet of gas, cooled by adiabatic expansion, impinges upon the material of the chamber, cooling the material at a rate that causes fracture. Pressure differential between the interior and exterior of the chamber then completes the implosion.

Figure 1G:
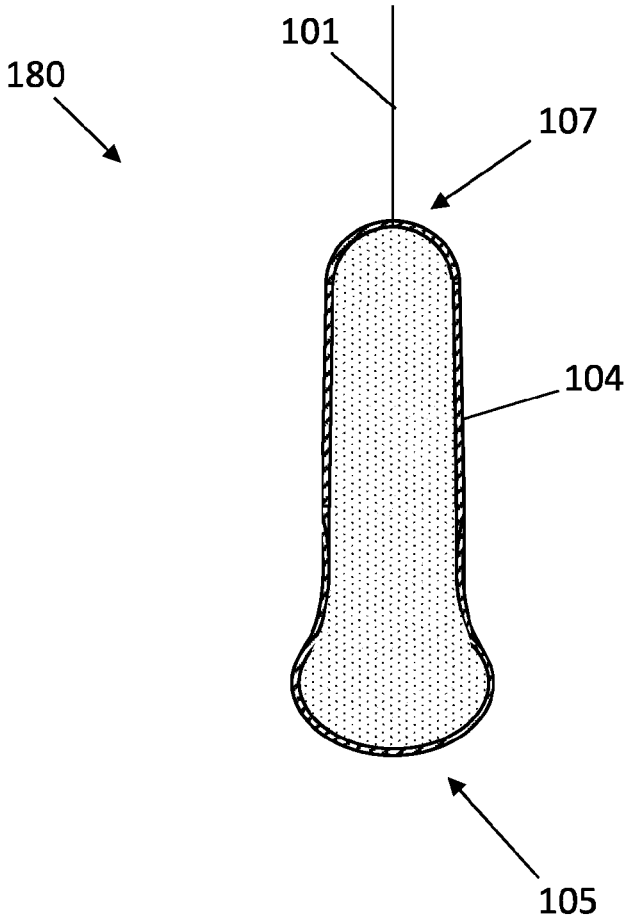
FIG. 1G is a schematic cross-sectional view of an implosion device in a state following activation, according to an embodiment of the disclosure.

Upon implosion, the sleeve 104 collapses around the imploded chamber 102 containing the pieces thereof and enabling the pieces of the imploded chamber to be removed from the well. FIG. 1G is a schematic cross-sectional view of an implosion device 180 following activation thereof. The resilient material of the sleeve 104 has returned to a neutral state, with broken pieces of an implosion chamber contained therein. No chamber pieces are left in the well, and no combustion products or other waste are left in the well. It should be noted that where a trigger chamber is used, the trigger chamber can also be contained within the sleeve 104 such that broken pieces of the trigger chamber are collected by the sleeve 104.

The sleeve 104 can be a sheet-like material that is circumferentially continuous and axially continuous from a first end 105 to a second end 107. The sleeve 104 can be cut to length from a spool of tubing and then stretched around the implosion chamber 102 and, where used, the trigger chamber 122. The sleeve 104 can be a partially continuous or discontinuous material. For example, the sleeve 104 can be a stretchy mesh, net, or string material. The sleeve 104 can also be a sheet-like material that has openings of any suitable type. The sleeve 104 can also be stretched around the implosion chamber 102, but not around the trigger chamber 122, if desired.

The implosion chamber 102 is generally sized to have a diameter similar to, and somewhat smaller than, the diameter of the well into which the implosion chamber is deployed in order to maximize the effect of the implosion on fluids in the perforation pores. The implosion chamber 102 has a length selected to affect a certain zone. The implosion chamber 102 can generally create underpressure enough to remove debris from a zone about twice the length of the implosion chamber.

Figure 1H:
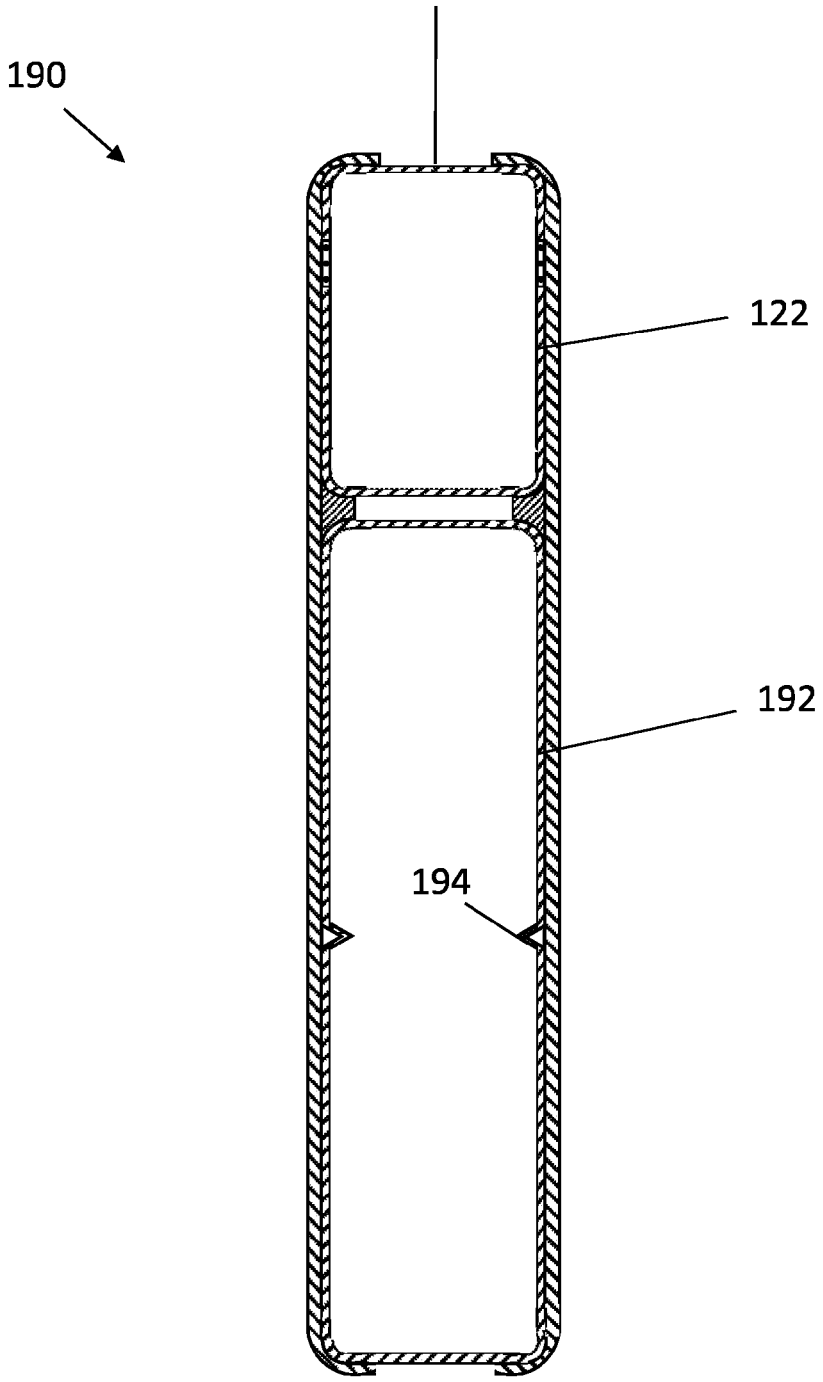
FIG. 1H is a schematic cross-sectional view of an implosion device, according to an embodiment of the disclosure.

Features can be incorporated into the implosion chamber to reduce the stimulus needed to create the implosion. In one case, the implosion chamber can be formed with a shape that increases stress in the material. The implosion chamber is generally made by firing a glass or ceramic material in a mold. A circumferential pinch, or zone of reduced diameter, can be formed in a cylindrical implosion chamber by molding or by molding two parts with reduced-diameter ends and then welding the reduced-diameter ends together. FIG. 1H is a schematic cross-sectional view of an implosion device 190 according to another embodiment. The implosion device 190 has an implosion chamber 192 with a stress feature 194 that increases stress within the material of the implosion chamber 192. The stress can be compressive or tensile, depending on how the stress feature 194 is formed. The stress feature is an induced departure in the shape of the implosion chamber 192 from a lowest stress shape, in this case a right circular cylinder. The stress feature 194 is a circumferential pinch located along the length of the implosion chamber 192 at about a middle position. In this case, the circumferential pinch forms a reduced diameter region of the implosion chamber 192 having a minimum diameter about 20% less than a diameter of the implosion chamber 192 outside the reduced diameter region. As mentioned above, the stress induced in the material of the implosion chamber 192 by the stress feature 194 can depend on how the stress feature is formed. For example, where the stress feature 194 is formed by applying a pinching device around a precursor body of the implosion chamber 192 during firing, the induced stress can be tensile. Where the stress feature 194 is formed by welding two precursor bodies together, each precursor body having a reduced diameter end, the stress can be compressive. Other types of stress features can be formed in an implosion chamber instead of, or in addition to, the circumferential pinch type stress feature 194. For example, longitudinal grooves can be formed that extend radially inward and/or outward in the material of the implosion chamber. In other cases, stress features can include spiral grooves that extend radially inward and/or outward. In other cases, the stress features can include bumps and depressions that extend radially inward and/or outward. Any feature can be induced in the shape of the implosion chamber to cause the matrix energy of the material of the implosion chamber to be above a minimum energy state. In general, use of such stress features increases brittleness of the implosion device 190 and makes the implosion device 190 more likely to rupture when experiencing transient pressure change events, such as the abrupt rupture of the trigger chamber 122.

The sleeve 104 shown in FIG. 1A and the sleeve shown in FIG. 1H have open ends at the bottom of the sleeve, suggesting the sleeve has strength at the opening to contain the implosion chambers shown in those figures so that the implosion chamber does not slip through the opening. To ensure the implosion chamber does not slip through the opening, a closed end can be used. An additional support can be disposed in the closed end, between the material of the sleeve and the end of the implosion chamber.

Where heat is to be used to cause the implosion, different materials can be fused together to form the implosion chamber in a way that creates stress in the materials as the chamber cools or warms. The implosion chamber can be formed with voids or gas pockets in some cases. For example, the implosion chamber can be made of a glass or ceramic foam to introduce porosity. If the implosion chamber is formed under a pressurized gas atmosphere, the compressive stress introduced into the material of the implosion chamber can enhance rupture of the material. Stress can be introduced into the material of the implosion chamber merely by rapidly cooling the implosion chamber after firing the material, for example by immersing the hot implosion chamber into a cold bath. In other cases, the implosion chamber can be formed by adding layers of different materials to create a laminated structure that can be thermally stressed due to different thermal properties of the laminated layers.

In other cases, solid particles of a different material can be incorporated into the material of the implosion chamber. These solid particles can have different energy absorption and/or thermal properties from the bulk material of the implosion chamber. For example, carbon black particles or graphite particles can be incorporated in a glass or ceramic bulk material to change the thermal properties of the implosion chamber.

In other cases, etching or scoring can be used to add breakability at selected locations of the implosion chamber, for example where an object is disposed to impact the implosion chamber to create breakage. In one case, a line or "x" shape can be scored on the external or internal surface of the implosion chamber where a hammer or puncture device is disposed to strike the implosion chamber, or where an optical device is to direct optical energy onto the implosion device, to increase breakability at the selected location without reducing overall strength of the implosion chamber.

Figure 1I:
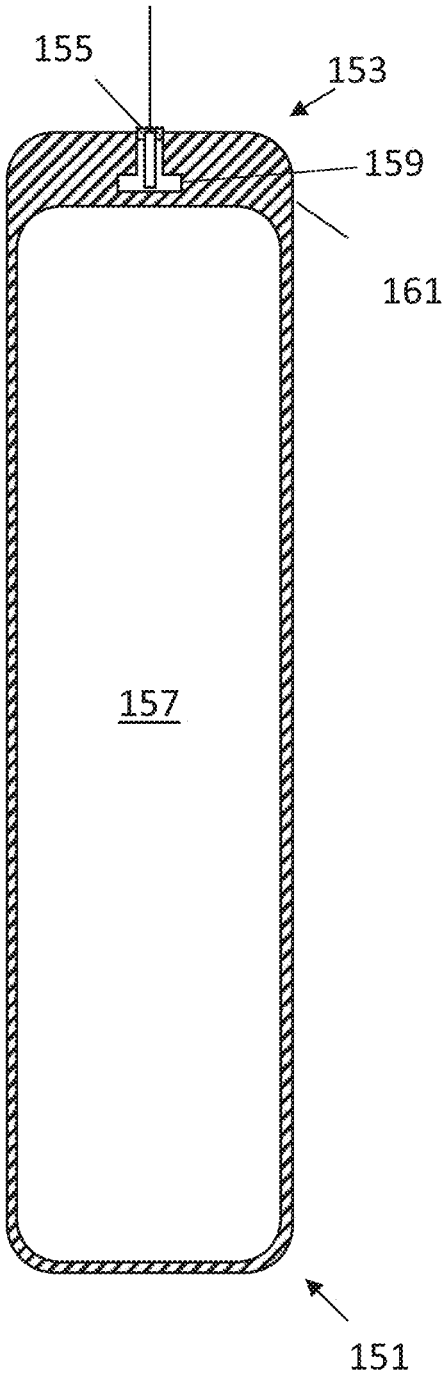
FIG. 1I is a schematic cross-sectional view of an implosion device, according to an embodiment of the disclosure.
Figure 1J:
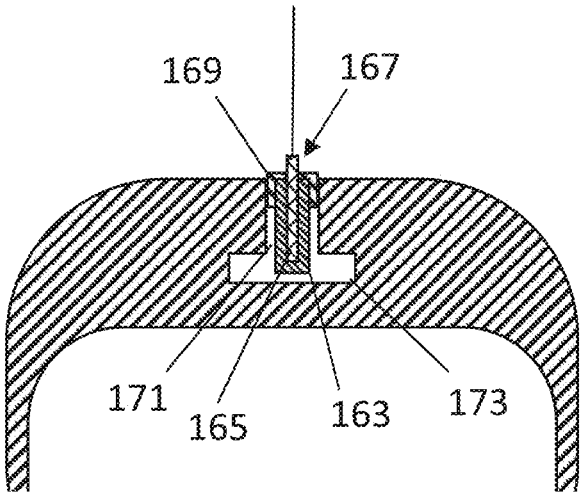
FIG. 1J is a close-up view of a trigger portion of the implosion device of FIG. 1I, according to an embodiment of the disclosure.

In some cases, the non-explosive initiator can be a non-impact stress applicator that applies stress to the implosion chamber, or to a trigger chamber, to trigger implosion. FIG. 1I is a schematic cross-sectional view of an implosion device 151 according to another embodiment. FIG. 1J is a close-up view of a trigger portion 153 of the implosion device 151 of FIG. 1I. The implosion device 151 uses a non-impact stress applicator 155 to apply stress to the material of the implosion chamber to cause the chamber to rupture and implode. The implosion device 151 comprises an implosion chamber 157 with a trigger recess 159 formed in a wall 161 thereof. The non-impact stress applicator 155 is installed in the trigger recess 159. The stress applicator 155 comprises a stress application material 163 jacketed around a heat element 165. The stress application material 163 is a substance that can melt at a modestly elevated temperature relative to ambient wellbore conditions, so the material will freeze at ambient wellbore conditions, and that expands upon freezing.

The stress applicator 155 is configured here with the stress application material 163 jacketed around a portion of the heat element 165. The heat element 165 has a power end 167 where power is connected to the heat element 165. The stress application material 163 is jacketed around the heat element 165, in this case, from a location spaced apart from the power end 167 to the end of the heat element 165 opposite from the power end 167, and covering the opposite end of the heat element 165. The stress applicator 155 may include a seal member 169 that fits around the heat element 165 at, or adjacent to, the power end 167 thereof to provide containment and environmental shielding for the stress application material 163.

The trigger recess 159 has a neck portion 171 and a pool portion 173. The neck portion 171 is configured to accept and support the stress applicator 155 within the neck portion 171. In this case, the outer diameter of the stress application material 163 is less than the inner diameter of the neck portion 171, so the stress application material 163 does not contact the inner wall of the neck portion 171 prior to activation. The seal member 169 contacts the inner wall of the neck portion 171 to seal the trigger recess 159 so the stress application material 163 does not escape from the trigger recess 159 and so that environmental substances do not intrude into the trigger recess 159.

The heat element 165 is configured to supply heat that can melt the stress application material 163. Upon melting, the stress application material 163 flows into the pool portion 173, conforming to the shape of the pool portion 173. The pool portion 173 is sized, with diameter and height, such that the melted stress application material 163 will fill the pool portion 173. When heat is no longer applied to the stress application material 163, either through loss of direct contact with the heat element 165 or discontinuing power to the heat element 165, the stress application material 163 freezes. Expansion of the stress application material 163 upon freezing applies stress to the material of the implosion chamber 157, causing the chamber to rupture and then implode.

Where heat is to be used to cause the implosion, different materials can be fused together to form the implosion chamber in a way that creates stress in the materials as the chamber cools or warms. The implosion chamber can be formed with voids or gas pockets in some cases. For example, the implosion chamber can be made of a glass or ceramic foam to introduce porosity. If the implosion chamber is formed under a pressurized gas atmosphere, the compressive stress introduced into the material of the implosion chamber can enhance rupture of the material. Stress can be introduced into the material of the implosion chamber merely by rapidly cooling the implosion chamber after firing the material, for example by immersing the hot implosion chamber into a cold bath. In other cases, the implosion chamber can be formed by adding layers of different materials to create a laminated structure that can be thermally stressed due to different thermal properties of the laminated layers. As discussed in other embodiments, a thermal source may include a heating element.

In another embodiment, the stress application material could be a non-melting material that applies stress to the material of the implosion chamber simply by thermal expansion. The heat element 165 could be jacketed with a copper or aluminum sleeve that is inserted into a trigger chamber that has tight tolerance around the outer diameter of the copper or aluminum sleeve. Thermal expansion of the sleeve then can create stress in the material of the implosion chamber to rupture the material. It should be noted that the non-impact stress applicator can also be used to activate a trigger chamber, as in FIGS. 1B-1F.

Figure 2A:
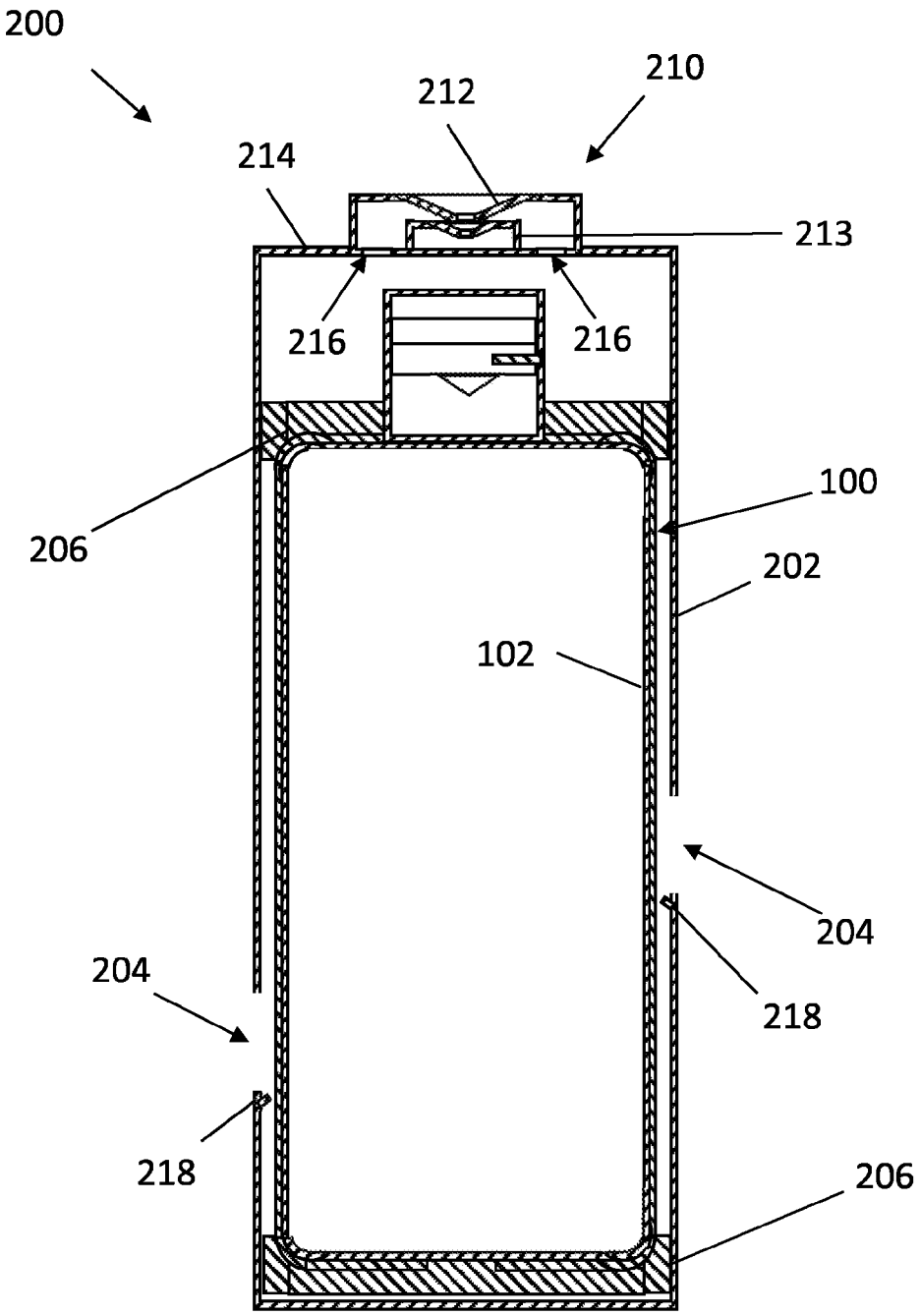
FIG. 2A is a schematic cross-sectional view of an implosion device, according to an embodiment of the disclosure.

The implosion chamber and sleeve can be housed in an outer housing. FIG. 2A is a schematic cross-sectional view of an implosion device 200 according to another embodiment. In this case, the implosion device 200 of FIG. 1A is disposed in a housing 202. The housing 202 can be used to provide structural strength to the apparatus and to prevent unwanted impacts to the implosion chamber 102 during handling and deployment.

The housing 202 has a plurality of openings 204 formed through the walls thereof to provide fluid continuity between the interior of the housing 202, where the implosion device 100 is disposed, and the exterior of the housing 202, where downhole pressures are ambient. In this way, downhole pressure is transmitted into the housing 202 interior so that, when the implosion chamber 102 is ruptured, the chamber 102 implodes to create the underpressure. The openings 204 can have any convenient shape, and can be distributed around the circumference, and along the length, of the housing 202 according to any convenient pattern or design. Openings can also be provided in the top and bottom of the housing 202, if desired. Any of the implosion devices 100, 120, 130, 150, 160, and 170, or other similar implosion device can be disposed in a housing, such as the housing 202. Spacers 206 can be used with housing 202 and the implosion device 100 (or other implosion device) to prevent unwanted impact between the implosion device 100 and the walls of the housing 202. The spacers 206 can be rings, as shown here, that fit around one or both ends of the implosion device, or the spacers 206 can be discrete (i.e. not annular) members that fit between the implosion device 100 and the housing 202.

A sampling device 210 can be coupled to the housing 202. The sampling device 210 provides a capture space for passively sampling debris and/or fluids downhole at the time the implosion chamber 102 implodes. The sampling device 210 has one or more flow guides 212 to guide fluid flow into a collection chamber 213 of the sampling device such that downhole debris is deposited into the collection chamber 213. Implosion of the chamber 102 creates fluid flow inward from the surrounding well material into the housing 202. The interior of the sampling device 210 is separated from the interior of the housing 202 by a common wall 214, which has one or more openings 216 to provide fluid continuity between the sampling device 210 and the interior of the housing 202. Upon implosion of the chamber 102, fluid flows into the sampling device 210 and through the openings 216, creating a fluid flow toward the collection chamber 213. The flow guides 212 guide the fluid flow toward the collection chamber 213 so that debris from the well is deposited in the collection chamber 213. Alternately, or additionally, other sampling features can be included in the interior of the housing 202. For example, sample containers 218, which can be cups, rings, or ring segments, can be positioned near the openings 204 to capture any debris that enters the housing through the openings 204.

Figure 2B:
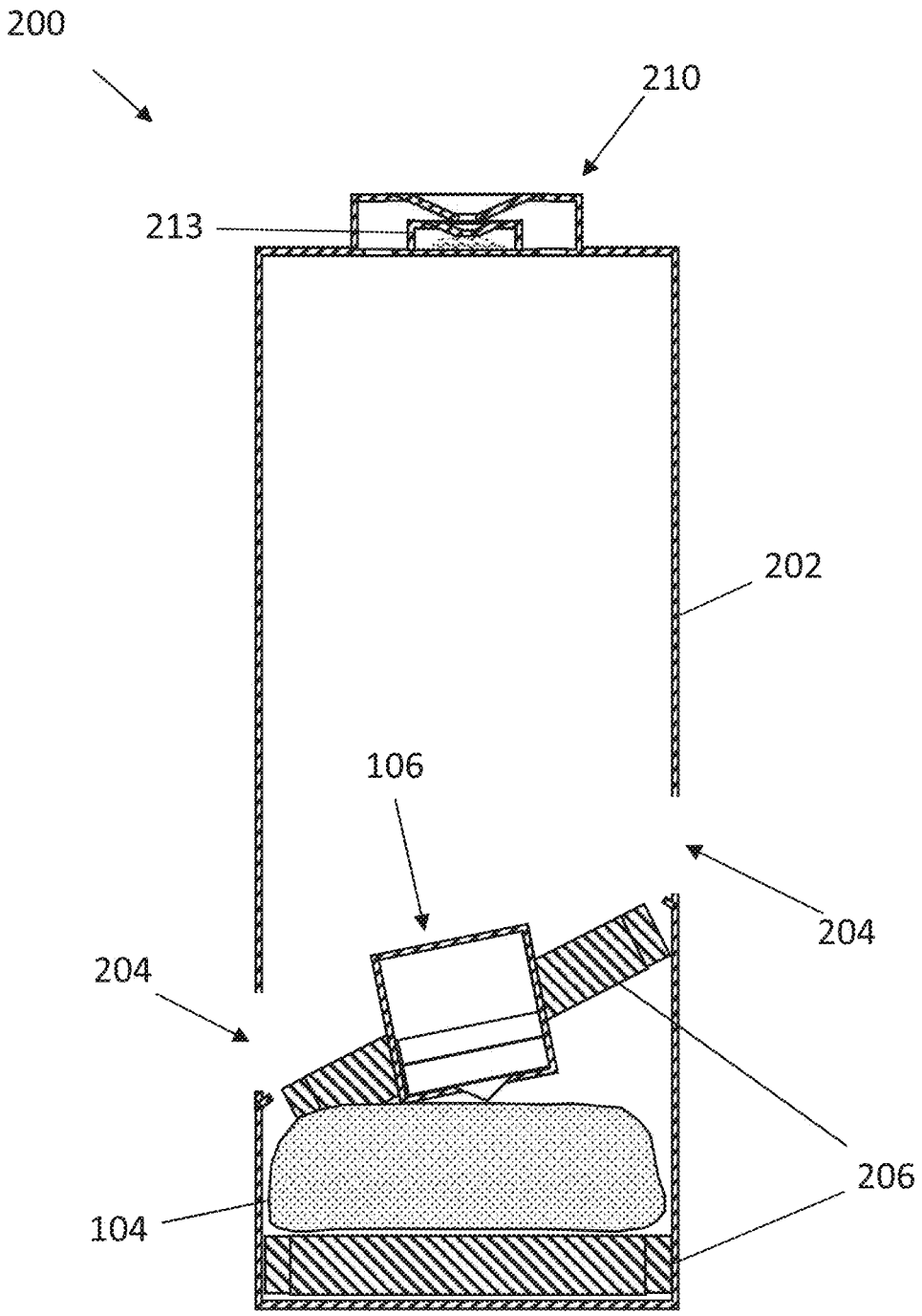
FIG. 2B shows the implosion device of FIG. 2A in a state following activation, according to an embodiment of the disclosure.

FIG. 2B shows the implosion device 200 in a post-activation state. The sleeve 104 has returned to its largely unstretched state, containing pieces of the implosion chamber 102 and laying at the bottom of the implosion device 200. The top spacer 206 and the initiator 106 are represented as being unsupported within the implosion device 200, so both have collapsed to the bottom of the device 200 as the implosion chamber 102 collapsed. A sample of debris has been drawn into the collection chamber 213 by the implosion. The device 200 can be recovered from the well and the sample recovered for analysis. It should be noted that one or both of the initiator 106 and the top spacer 206 can be supported within the housing 202 to avoid those components collapsing with the implosion of the chamber 102.

Figure 3A:
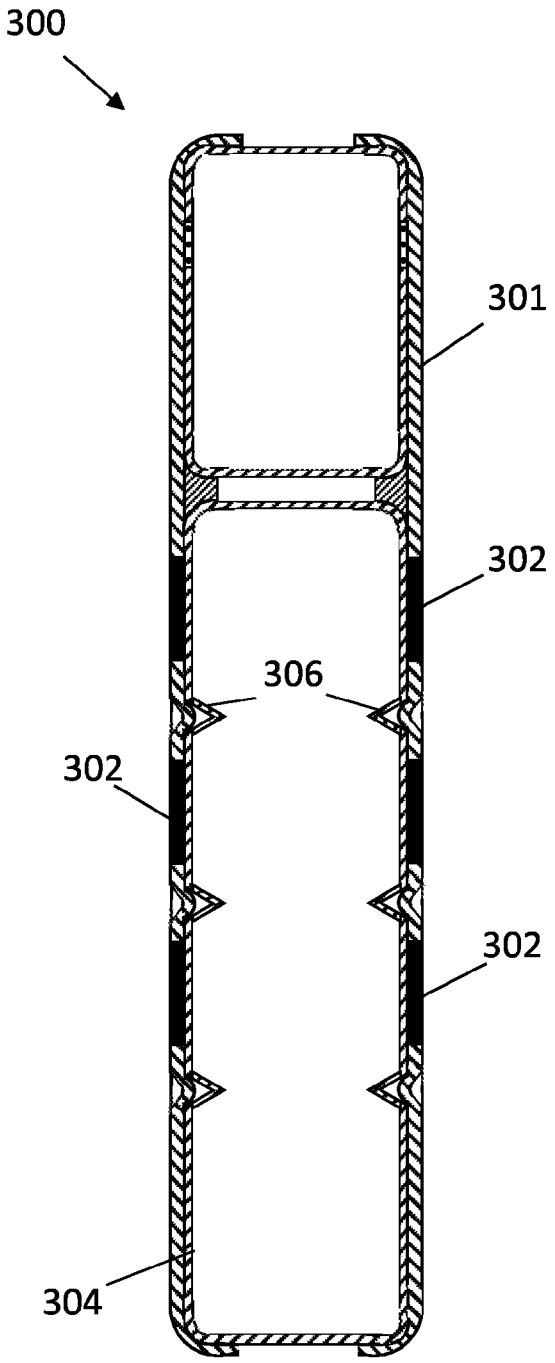
FIG. 3A is a schematic cross-sectional view of an implosion device having sampling features, according to an embodiment of the disclosure.

Sampling can be provided by features of the sleeve, which can serve as sampling devices. The features can be any, or all, of internal to the sleeve or external to the sleeve. FIG. 3A is a schematic cross-sectional view of an implosion device 300 having sampling features according to one embodiment. In this case, the implosion device 300 has a sleeve 301 with a plurality of rings 302 built into the material of the sleeve 301. The sleeve 301 comprises a sheet-like stretchy material that has the plurality of rings 302 embedded into the sheet-like material to constrain the shape of the sheet-like material in one dimension (i.e. radially). The rings are stiff material, such as steel or another structurally strong material. The sheet-like material thus will not stretch or shrink radially where one of the rings 302 is embedded in the sheet-like material, but between the rings 302 the sheet-like material will stretch and shrink radially. The sheet-like material will also stretch and shrink axially. An implosion chamber 304 is disposed within the sleeve 301, the implosion chamber 304 in this case having reduced-diameter portions 306 for increased breakability. The resilient material of the sleeve 301 follows the shape of the implosion chamber 304 between the rings 302.

Figure 3B:
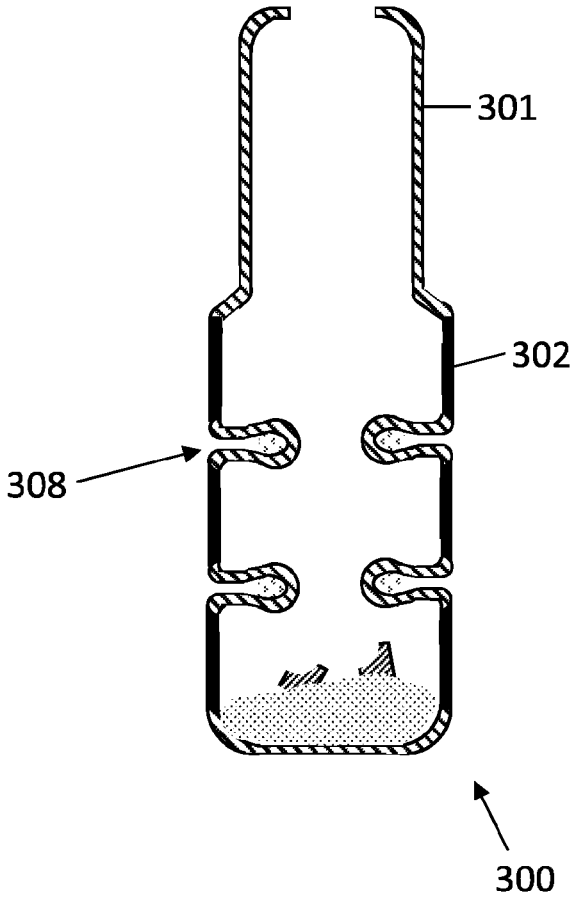
FIG. 3B is a schematic cross-sectional view of the implosion device of FIG. 3A in a state following activation, according to an embodiment of the disclosure.

When the implosion chamber 304 ruptures, portions of the sleeve 301 collapse in an axial direction and in a radial direction. The portions of the sleeve 301 having the rings 302 do not change shape substantially, being constrained by the rigidity of the rings. The portions of the sleeve 301 unconstrained by the rings retract to a minimum energy state with no internal structure to stretch the sleeve 301. Fluid drawn toward the implosion device by the sudden reduction in volume carries particles that impinge upon the sleeve 301. Shrinkage of the sleeve 301 between the rings 302 creates sample compartments 308. As the sleeve 301 shrinks, fluid and particles in the compartments 308 become trapped by closure of the rings 302 together. FIG. 3B is a schematic cross-sectional view of the implosion device 300 after rupture of the implosion chamber 304. The sleeve 301 has shrunk to a minimum energy shape, with the sheet-like material having formed the compartments 308 in which sample material is captured.

Figure 4A:
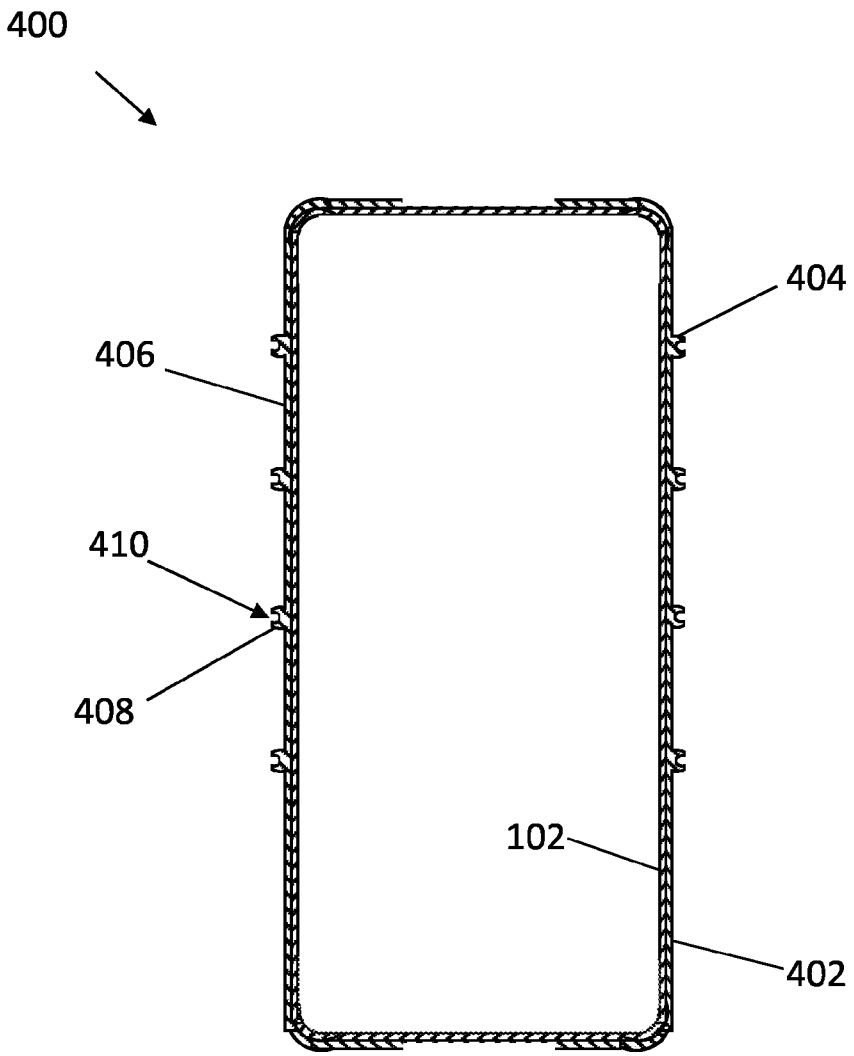
FIG. 4A is a schematic cross-sectional view of an implosion device with pre-formed external sampling features, according to an embodiment of the disclosure.

Sampling features can be provided on an exterior surface of the sleeve as well. FIG. 4A is a schematic cross-sectional view of an implosion device 400 that features a sleeve 402 with external sampling features 404 pre-formed on the exterior surface of the sleeve 402. This implosion device 400 uses the implosion chamber 102 as an example. Triggering and support members are omitted here for simplicity, but any convenient triggering member and support member can be used, as described elsewhere herein. As before, the sleeve 402 is made of a stretchy material, and the sampling features 404 are formed as an integral part of the stretchy material of the sleeve 402. Such features can be formed, for example, by molding the sleeve 402 using a rubber, or other stretchy, material.

The pre-formed sampling features 404 extend radially outward from an outer surface 406 of the sleeve 402 and are shaped with a wall portion 408 and a recess 410 inward from the wall portion 408. In one embodiment, the wall portions 408 protrude about 3 mm from the exterior of the sleeve 402 when an implosion chamber is housed within the sleeve 402. The sampling features 404 can be circumferential grooves or cup-like features (since FIG. 4A is a cross-section, grooves would not be distinguishable from cup-like features), and may be provided in any convenient number or arrangement along the outer surface 406. Here, the sampling features 404 are uniformly spaced along an axial direction of the sleeve 402. Viewed as cup-like features, the sampling features 404 are in pairs, each pair at an axial location of the sleeve 402 with 180° azimuthal displacement. That is, viewed as cup-like features, each pair of sampling features 404 are arranged across from each other, in other words arranged along a diameter of the sleeve 402. Viewed as grooves, the sampling features 404 are uniformly spaced along the axial direction and extend around the sleeve 402 in a planar fashion substantially perpendicular to the axial direction.

The pre-formed sampling features 404 are configured to open when the stretchy material of the sleeve 402 is stretched by insertion of an implosion chamber, using the implosion chamber 102 here as an example. Stretching the material causes the wall portions 408 of the sampling features 404 to spread to an open shape that exposes the recesses 410 to the surrounding environment. When the implosion chamber 102, or any implosion chamber that stretches the sleeve 402, implodes, the sleeve 402 returns to its minimum energy "unstretched" shape and the wall portions 408 of the sampling features 404 close to capture any material in the vicinity within the recesses 410. As above, where activation of the implosion device 400 causes movement of fluid toward the implosion device 400, samples of the fluid can be captured in the recesses 410 when the wall portions 408 close.

Figure 4B:
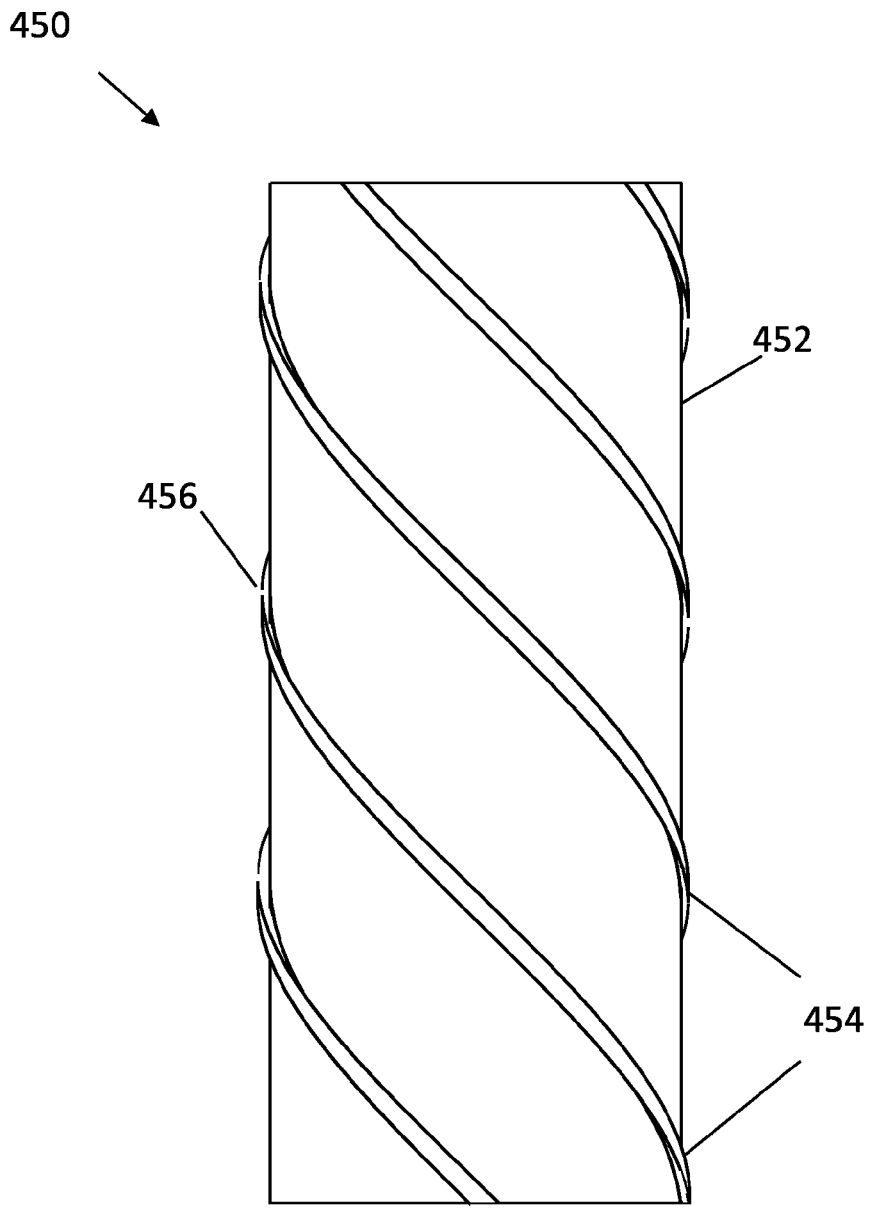
FIG. 4B is a schematic side view of an implosion device with pre-formed external sampling features, according to an embodiment of the disclosure.

Sampling features 404 can be deployed along the outside surface of a sleeve in any suitable configuration. Cup-like or box-like features can be used and can be combined with groove-like features in any number or arrangement. FIG. 4B is a schematic side view of an implosion device 450, according to another embodiment. Here, only an outer sleeve 452 is visible, since the implosion chamber is inside the sleeve 452. The sleeve 452 has a plurality of pre-formed sampling features 454 on the outer surface thereof. The sampling features 454 function in a manner similar to the sampling features 404 of the implosion device 400, opening when stretched and closing when the stretching is released. The sampling features 454 are groove-like and are arranged in a helical pattern along the outer surface of the sleeve 452. Thus, each sampling feature has two helical wall portions 456 that extend outward from the sleeve 452, wrapping around the cylindrical form of the sleeve 452, which is stretched around the implosion chamber within. Four sampling features 454 are shown here (the sampling feature portions at the top and bottom are part of one sampling feature wrapping around the sleeve), but any number of sampling features 454 can be used, and parameters such as pitch and spacing can be chosen. Length of extension outward from the surface of the sleeve 452 can also be selected by design of the shape of the wall portions 456. For example, the wall portions 456 can be designed to spread outward more or less when the sleeve 452 is stretched by adjusting the shape of the wall portions 456.

It should be noted that, in general, sampling features can be continuous, like the sampling features 454 of FIG. 4B, partially continuous, or discrete like the cup-like version of the sampling features 404 of FIG. 4A, and can be circumferentially aligned, like the groove version of the sampling features 404 of FIG. 4A, axially aligned, or angled in a helical manner, like the sampling features 454. Size of the sampling features can also be selected by choosing an appropriate shape for the sleeve. Larger sampling features can be provided if material to be sampled is expected to be sparse and space sufficient for large sampling features, and smaller sampling features can be selected if space is limited. Sampling features of different sizes and shapes can be provided on a single sleeve, or all sampling features on one sleeve can be the same. Different sections of sampling features can be provided having different characteristics. For example, a first group of sampling features can be large and widely spaced while a second group of sampling features are small and closely spaced. As another example, a first group of sampling features can be elongated (i.e. groove-like) while a second group of sampling features are relatively symmetrical (i.e. cup-like). It should also be noted that sampling features protruding from the exterior of the sleeve, as exemplified in FIGS. 4A and 4B, can provide impact protection and well wall stand-off as the implosion devices are handled and deployed downhole.

Figure 4C:
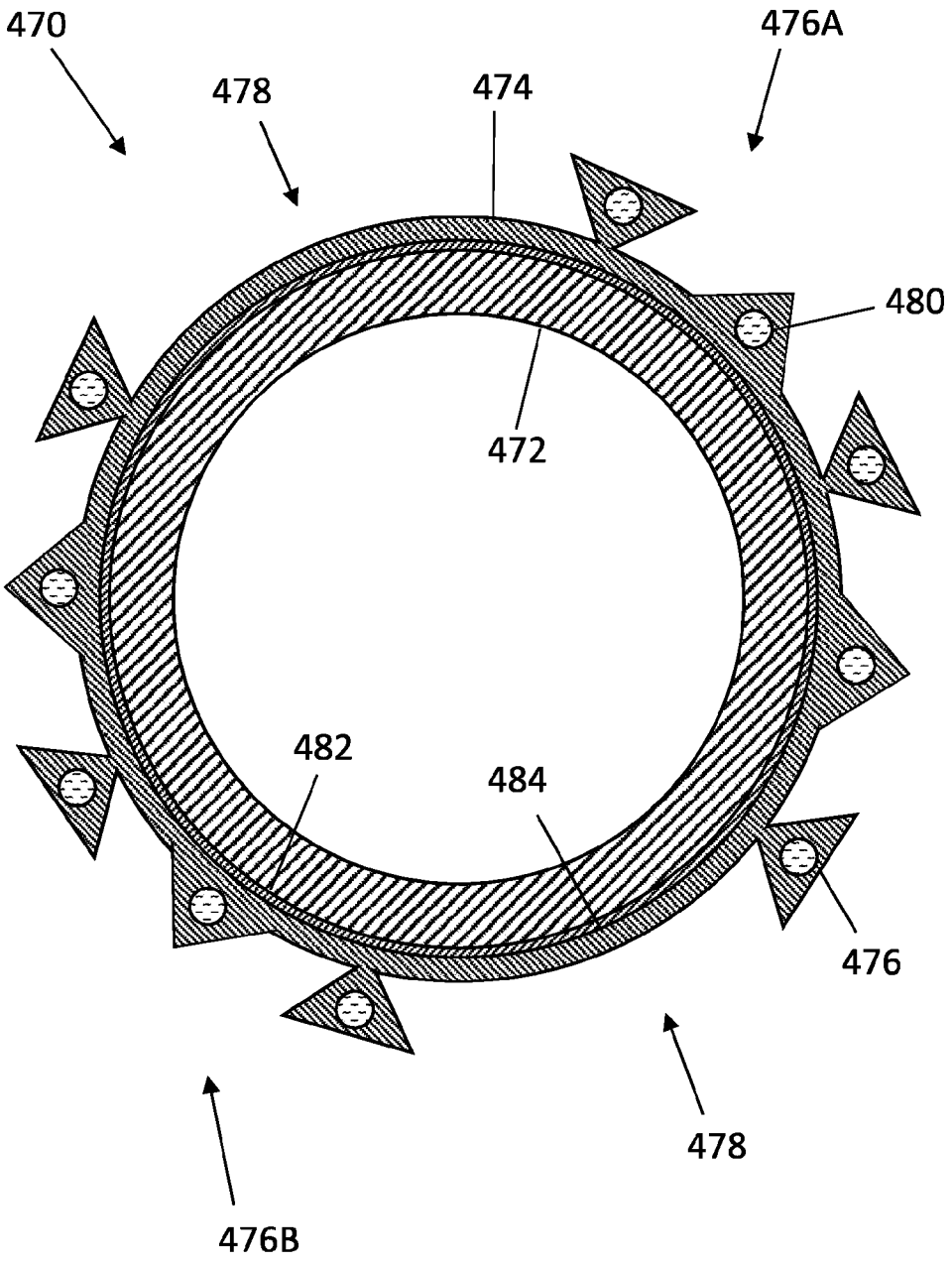
FIG. 4C is a schematic cross-sectional view of an implosion device, according to an embodiment of the disclosure.

FIG. 4C is a schematic cross-sectional view of an implosion device 470, according to another embodiment. In this case, the section plane is perpendicular to the axis of the implosion device to illustrate axially aligned features of the implosion device 470. The implosion device 470 has an implosion chamber 472 disposed inside a sleeve 474 that has protrusions 476. The protrusions 476 are distributed around the circumference of the sleeve 474 in a way that defines a first plurality 476A of protrusions and a second plurality 476B of protrusions located generally on a side of the sleeve 474 opposite from the first plurality 476A such that there is at least one gap 478 between the first and second pluralities 476A and 476B. In this case, the protrusions 476 are grouped symmetrically around the circumference of the sleeve 474 such that there are two gaps 478 on opposite sides of the sleeve 474.

The protrusions 476 are shaped such that neighboring protrusions 476 will nest together when the sleeve 474 is relaxed or in a minimum energy state and will spread apart when the sleeve 474 is stretched to accommodate the implosion chamber 472. The protrusions 476 that define the gaps 478 (i.e. the protrusions 476 on either side of the gaps 478) are configured, in this case, to form a sample chamber when the sleeve 474 is relaxed. Here, the protrusions 476 are triangular, with adjacent protrusions 476 in opposite, point-up and point-down, orientations. The protrusions 476 on either side of the gaps 478 are oriented point-down so that the bases of the triangular protrusions approach each other when the sleeve 474 relaxes to form the sample chamber between the two point-down protrusions 476.

The sleeve 474, in this case, includes strength members 480 disposed within the protrusions 476. The strength members 480 are rod-like or cable-like members, such as steel wires, that provide strength for the sleeve 474 along the axial direction. The strength members 480 can absorb impacts to the sleeve 474 and prevent the sleeve 474 from deforming significantly in a radial direction upon impact. Such impacts can prematurely rupture the implosion chamber 472, so preventing such deformations can prevent such ruptures. The protrusions 476 also provide well wall stand-off for the implosion device 470. It should be noted that any of the sleeves described herein can be provided with strength members like the strength members 480, and the strength members can also take the form of rings like the rings 302 of FIG. 3A. The strength members can be made of any structurally strong material, such as steel or hard plastic, and can be provided in any suitable number or arrangement.

As with the other embodiments described herein, upon rupture, the implosion chamber 472 becomes broken pieces that are contained within the sleeve 474. In some cases, the broken pieces can have sharp edges or points that can puncture the material of the sleeve 474. In this case, a puncture resistant liner 482 is provided on an interior surface 484 of the sleeve 474 to minimize the risk that a broken piece of the implosion chamber 472 could puncture the sleeve 474. The puncture resistant liner 482 may be adhered to the interior surface 484 using adhesive or thermal attachment. Any of the sleeve embodiments described herein can be provided with a puncture resistant liner. Even the partially discontinuous sleeve embodiments described herein could have a puncture resistant liner. The puncture resistant liner can be adhered to the interior of a mesh or string bag embodiment. Where a mesh or string is used as a bag for the broken pieces, instead of a liner, the mesh or string fibers could be coated with a puncture or cutting resistant material. It should be noted that sampling features distributed axially along the sleeve or implosion device can be used to provide location-related composition information. The location of each sampling feature in the well can be recorded at the time the implosion is activated (or can be inferred from a single reference location of the implosion device), and the composition of material in each sampling feature can be related to the location of that sampling feature. Such information can be compared to other well data and used to plan other well completion activities.

A single down-hole tool may have more than one implosion device of any kind described herein. The number of implosion devices in a single tool can be selected based on a number of implosion events desired while the tool is downhole. For example, if two zones of a formation are perforated by a single tool while the tool is downhole, two implosion devices can be deployed to sweep out the two perforated zones. The multiple implosion devices can be adjacent, in an implosion section of the tool, or the implosion devices can be distributed according to any plan. For example, where two perforation tools are used, an implosion device can be located adjacent to each perforation tool to minimize the need for tool movements between perforation events and implosion events. Alternately, where concussion from a perforation tool might prematurely rupture an implosion chamber or trigger chamber, the implosion devices can be located in a section of the downhole tool that is remote from the perforation tools. In such cases, the tool can be moved to position perforation and implosion devices as needed. A baffle device can be included in the downhole tool between a perforation tool and an implosion device to reduce propagation of pressure waves from the perforation tool to the implosion device, thus reducing the possibility of premature deployment of the implosion device. The baffle device can be any device configured to reduce propagation of pressure waves. For example, the baffle device can be a cylindrical body connected between the perforation tool and the implosion device, with appropriate electrical continuity components. The cylindrical body can have vanes, fingers, and the like extending outward to provide barriers to pressure wave propagation.

Figure 5:
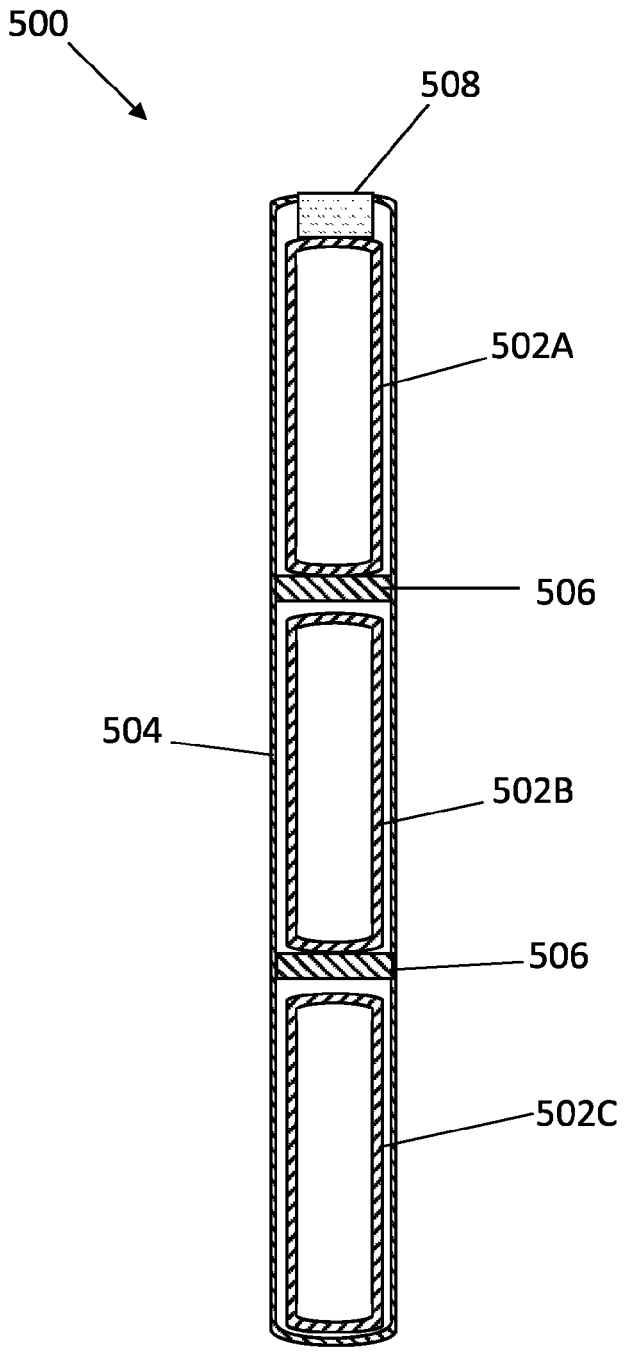
FIG. 5 is a schematic cross-sectinal view of an implosion device, according to an embodiment of the disclosure.

FIG. 5 is a schematic cross-sectional view of an implosion device 500 according to another embodiment. The implosion device 500 has three implosion chambers 502A, 502B, and 502C disposed within a sleeve assembly 504. The sleeve assembly 504 has spacers 506 disposed between neighboring implosion chambers 502. An initiator assembly 508 is provided adjacent to one of the implosion chambers 502 to start an implosion chain reaction that propagates by pressure shock. The initiator assembly 508 can be any of the types of initiator assemblies described herein. The sleeve assembly 504 has a sleeve material for each implosion chamber 502, the sleeve material extending from one spacer 506 to a neighboring spacer 506. The spacers 506 can be any suitable material, but a surface of the spacer 506 that contacts an implosion chamber 502 will be made of a material selected to prevent breakage of the material of the implosion chamber 502 by contact. Thus, the spacers 506 may be made of a "soft" or pliable material, or may have a surface pad made of such material, on one or both sides of the spacer 506, for contacting the implosion chamber 502.

Figure 6:
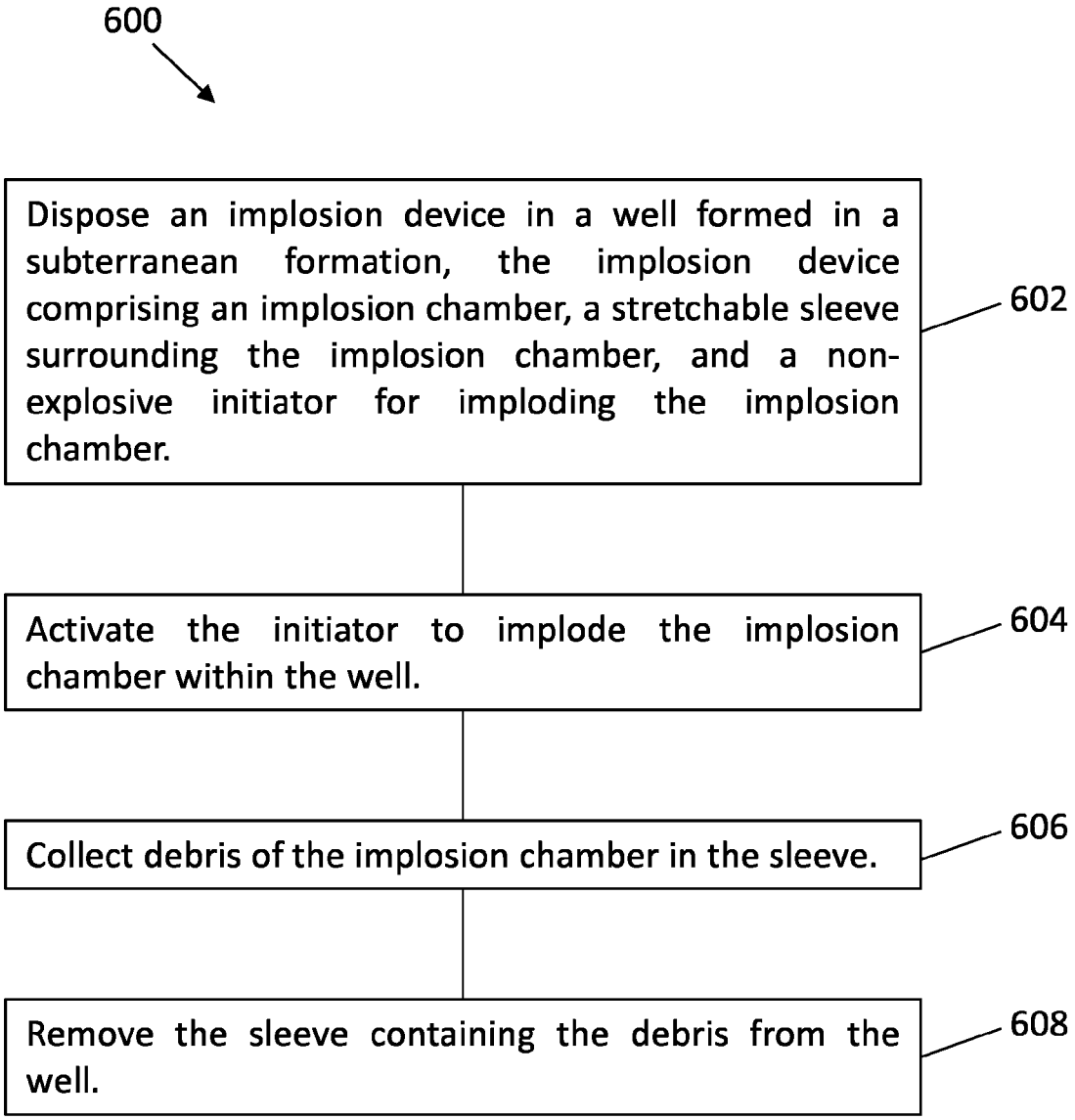
FIG. 6 is a flow diagram summarizing a method, according to an embodiment of the disclosure.

FIG. 6 is a flow diagram summarizing a method 600 according to one embodiment. The method 600 is a method of treating a subterranean formation. Typically, when the method 600 is used, a well has been formed to access the subterranean formation and the formation has been subjected to a perforation process to open paths within the formation for fluid flow. The method 600 can be used to remove debris that may be blocking the paths.

At 602, an implosion device is disposed within the well. The implosion device is used to create a transient underpressure at a desired location in the well to move fluids within the well in a direction away from the outer wall of the well toward the center of the well. The flow of fluids is typically abrupt and forceful enough to move solids out of the paths formed in the well wall by perforation and into the well itself, thus opening the pathways for improved fluid flow. The implosion device comprises an implosion chamber, a stretchable sleeve surrounding the implosion chamber, and a non-explosive initiator for imploding the implosion chamber.

The implosion chamber can be any of the implosion chambers described herein, made of a material that can be broken to implode the implosion chamber, such as glass or ceramic, and can have features to enhance breakability, such as energy absorption features or stress features as described above. The material of the implosion chamber can be enhanced in any suitable way, such as by including enhancing materials or structures like solid particles or bubbles. The implosion chamber is typically formed from a precursor material that is shaped into the form of the chamber and then baked or fired. The process of forming the implosion chamber may be performed at atmospheric pressure or positive or negative pressure to target an interior pressure of the finished implosion chamber, which can be at, above, or below atmospheric pressure. The implosion chamber is formed to have a wall thickness suitable for handling and process conditions to be encountered in deploying the implosion device into the well so that the implosion chamber does not rupture prematurely or in an uncontrolled fashion.

The sleeve can be any of the sleeve embodiments described above, a sheet-like material that can be continuous, partially continuous, or discontinuous in any suitable way, or a mesh or string-like material. The sleeve can include sampling features as described above, and can contain one implosion device or more than one implosion device. The sleeve can contain strength members or form members such as the rods and rings described above, and can have a puncture-resistant liner or coating. The sleeve is configured to contain debris from activation of the implosion device for easy removal from the subterranean environment.

The initiator can be mechanical, electromechanical, energy-based, or any combination thereof, as described above. The initiator can use a physical puncture device, which can be mechanically or electrically triggered, to strike the implosion chamber, or a trigger chamber can be used to create a pressure shock that ruptures the implosion chamber. Acoustic, optical, or thermal means can also be used to rupture the implosion chamber or a trigger chamber.

At 604, the initiator is activated to implode the implosion chamber within the well. The implosion device is positioned at a location suitable for using a pressure transient to create an inward radial impulse in the well fluids that can move debris from perforations in the formation into the well, clearing the perforations for fluid flow. Perforations located a distance of about 5 meters or less from the implosion device can be at least partially cleared of debris using an implosion device as described herein, depending on the ambient formation pressure where the implosion device is activated. The pressures can be used to plan a configuration of the implosion device to achieve the desired results and to position the implosion device for activation.

At 606, debris of the implosion chamber is collected in the sleeve after activation. As noted above, the sleeve may have a puncture resistant liner or coating to resist damage from sharp edges of the debris. The debris can include pieces of the implosion chamber, pieces of a trigger chamber, portions of the initiator such as puncture devices and energy devices, and spacers deployed within the sleeve to provide space between trigger chambers and implosion chambers or between multiple implosion chambers. The debris can also include well debris. Where sampling features are used, the sampling features may also contain well debris. As noted above, composition of the well debris can be used to plan other well completion activities.

At 608, the sleeve containing the debris of the implosion device is removed from the well leaving little or no trace of the implosion device in the well.

Apparatus described herein can be used to practice various methods of creating underpressure in a well bore and using such underpressure to clear debris from channels formed in the wall of a hydrocarbon well by perforation. An implosion chamber is made of a strong but breakable material, such as ceramic or glass, and is lowered into the well bore. The material may include reinforcing components, or the material may include components, such as energy absorbing components or thermally expansive components, that enhance breakability under certain circumstances. The implosion chamber can also be made with geometric features that enhance breakability or stress within the material of the implosion chamber. For example, abrupt dimensional changes, such as corners and pinches, can be shaped into the implosion chamber.

Prior to lowering into the well, the implosion chamber is disposed within a protective sleeve. The protective sleeve is made of a material that stretches to surround the implosion chamber, and that also provides some protection to the implosion chamber from unwanted impacts during handling and deployment that might break the implosion chamber prematurely. The protective sleeve can be made of a rubber material, such as styrenic rubber or silicone rubber, and is cut to a length to accommodate the implosion chamber.

The implosion chamber, enclosed in the protective sleeve, is coupled to an initiator, which can be a physical breaking mechanism or an energy application device. The initiator may be used to break the implosion chamber directly, or a trigger chamber can be assembled with the implosion chamber and the initiator, such that the initiator activates the trigger chamber, which implodes to create a pressure shock that, in turn, implodes the implosion chamber. The trigger chamber and the implosion chamber both implode by action of downhole pressure on the implosion chamber when the chamber is ruptured. Where a trigger chamber is used, the sleeve typically surrounds both the trigger chamber and the implosion chamber so that implosion debris of both chambers can be captured and easily removed from the subterranean environment. The implosion chamber is formed with atmospheric, or near atmospheric, pressure inside the chamber. The pressure within the implosion chamber may be below atmospheric pressure if the implosion chamber is formed and baked or fired in an environment of atmospheric pressure. Cooling the chamber formed under such circumstances can result in a slightly reduced pressure within the chamber. When subjected to the high pressures within a hydrocarbon well, and when ruptured, the chamber rapidly implodes to create an large pressure gradient from high pressure at the well wall to low pressure near the center of the well. The pressure gradient causes fluid to flow abruptly from the well wall toward the center of the well, pulling debris from perforations in the well wall.

In accordance with certain embodiments of the present disclosure, a well-completion tool includes an implosion chamber, a stretchable sleeve surrounding the implosion chamber, and a non-explosive initiator for imploding the implosion chamber. In some embodiments, the initiator includes a trigger chamber. In some embodiments, the initiator includes a hammer and a restraint operable to release the hammer to break the implosion chamber. In some embodiments, the initiator includes a hydraulic puncture device. In some embodiments, the hydraulic puncture device is electronically activated.

In some embodiments, the initiator includes a mechanical or electromechanical puncture device with a restraint operable to release the puncture device to break the trigger chamber. In some embodiments, the initiator includes an acoustic or optical initiator. In some embodiments, the implosion chamber has stress features. In some embodiments, the initiator is a non-impact stress applicator. In some embodiments, the well-completion tool includes a housing surrounding the implosion chamber.

In some embodiments, the implosion chamber, the sleeve, and the initiator define an implosion device, and the well-completion tool includes a sampling device coupled to the implosion device and configured to passively sample surrounding fluids when the implosion device is activated. In some embodiments the sampling device is a feature of the sleeve.

In accordance with certain embodiments of the present disclosure, an implosion device for subterranean use includes an implosion chamber having an interior pressure that is at or below atmospheric pressure, a stretchable sleeve surrounding the implosion chamber, and a non-explosive initiator for imploding the implosion chamber. In some embodiments, the initiator includes a trigger chamber to create a pressure wave for imploding the implosion chamber and a mechanical or electromechanical puncture device with a restraint operable to release the puncture device to break the trigger chamber. In some embodiments, the initiator includes a trigger chamber to create a pressure wave for imploding the implosion chamber and an acoustic or optical energy device to break the trigger chamber.

In some embodiments, the implosion device includes a housing surrounding the implosion chamber. In some embodiments, the implosion device includes a sampling device configured to passively sample surrounding fluids when the implosion device is activated. In some embodiments, the sampling device is a feature of the sleeve.

In accordance with certain embodiments of the present disclosure, a method of treating a subterranean formation includes disposing an implosion device in a well formed in the subterranean formation. The implosion device includes an implosion chamber having an interior pressure that is at or below atmospheric pressure, a stretchable sleeve surrounding the implosion chamber, and a non-explosive initiator for imploding the implosion chamber. The method also includes activating the initiator to implode the implosion chamber within the well, collecting debris of the implosion chamber in the sleeve, and removing the sleeve containing the debris from the well. In some embodiments, the method includes coupling a passive sampling device to the implosion device. The passive sampling device is configured to sample fluids moved by activation of the implosion chamber. In some embodiments, activating the initiator includes signaling an electromechanical puncture device to break a trigger chamber.

The preceding description has been presented with reference to present embodiments. Persons skilled in the art and technology to which this disclosure pertains will appreciate that alterations and changes in the described structures and methods of operation can be practiced without meaningfully departing from the principle, and scope of this present disclosure. Accordingly, the foregoing description should not be read as pertaining only to the precise structures described and shown in the accompanying drawings, but rather should be read as consistent with and as support for the following claims, which are to have their fullest and fairest scope.

We claim:

1. A well completion tool, comprising:

an implosion chamber;

a non-explosive initiator configured to implode the implosion chamber, wherein the non-explosive initiator comprises a thermal initiator including a thermal source, wherein the thermal source includes a heating element disposed within a wall of the implosion chamber, and wherein the wall includes a recess including a neck portion and a pooling chamber portion, and wherein the heating element is at least partially disposed in the recess;

a stretchable sleeve surrounding the implosion chamber, the stretchable sleeve configured to contain debris resulting from activation of the non-explosive initiator, the stretchable sleeve being removable from a well with the debris after implosion of the implosion chamber; and a stress application material disposed around the heating element, wherein the heating element is configured to melt the stress application material, wherein the melted stress application material is configured to fill the pooling chambe portion, and wherein resolidification of the stress application material within the pooling chamber portion causes the implosion chamber to implode.

2. The well completion tool of claim 1, wherein the thermal source includes a cooling source configured to cool the implosion chamber to implode the implosion chamber.

3. The well completion tool of claim 1, wherein the implosion chamber, the stretchable sleeve, and the non-explosive initiator define an implosion device, and the well completion tool further comprises a sampling device coupled to the implosion device and configured to passively sample surrounding fluids when the implosion device is activated.

4. The well completion tool of claim 3, wherein the sampling device is a feature of the stretchable sleeve.

5. The well completion tool of claim 1, wherein the heating element includes a power end protruding from the recess, and wherein the power end is connected to a power supply configured to supply power to the heating element.

6. The well completion tool of claim 1, wherein the stress application material includes one or more of bismuth or a bismuth alloy.

7. The well completion tool of claim 1, wherein a seal member disposed around the heating element is configured to contact an inner surface of the neck portion of the recess and is further configured to seal the recess.

8. The well completion tool of claim 1, wherein:

the implosion chamber comprises a zone of reduced diameter;

the implosion chamber comprises at least a first layer having a first material and a second layer having a second material, wherein the first layer and the second layer create a laminated structure;

and the implosion chamber further comprises etching or scoring at a location of the implosion chamber.

* * * * *